US011656003B2

(12) United States Patent
McBean et al.

(10) Patent No.: US 11,656,003 B2
(45) Date of Patent: May 23, 2023

(54) CLIMATE-CONTROL SYSTEM HAVING VALVE ASSEMBLY

(71) Applicant: Emerson Climate Technologies, Inc., Sidney, OH (US)

(72) Inventors: James W. McBean, Bellefontaine, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 336 days.

(21) Appl. No.: 16/814,487

(22) Filed: Mar. 10, 2020

(65) Prior Publication Data

US 2020/0291943 A1 Sep. 17, 2020

Related U.S. Application Data

(60) Provisional application No. 62/816,626, filed on Mar. 11, 2019.

(51) Int. Cl.
*F04C 18/02* (2006.01)
*F04C 29/04* (2006.01)
(Continued)

(52) U.S. Cl.
CPC ..... *F25B 1/04* (2013.01); *F04C 14/24* (2013.01); *F04C 14/26* (2013.01); *F04C 18/02* (2013.01);
(Continued)

(58) Field of Classification Search
CPC ..... F04C 14/24; F04C 14/26; F04C 28/24; F04C 28/26; F04C 28/28; F04C 23/008;
(Continued)

(56) References Cited

U.S. PATENT DOCUMENTS 1,493,064 A * 5/1924 Brasington ..... F04B 49/02 137/492.5
3,884,599 A 5/1975 Young et al.
(Continued)

FOREIGN PATENT DOCUMENTS

AU 607745 B2 3/1991
CN 1060699 A 4/1992
(Continued)

OTHER PUBLICATIONS

English translation of JPH0515061 by PE2E Jul. 26, 2022.*
(Continued)

*Primary Examiner* — Deming Wan
(74) *Attorney, Agent, or Firm* — Harness, Dickey & Pierce, P.L.C.

(57) ABSTRACT

A compressor includes a shell, first and second scroll members, a fitting assembly and a valve assembly. The first scroll member includes a first end plate having a first spiral wrap extending therefrom. The second scroll member includes a second end plate having a second spiral wrap extending therefrom and an injection passage formed in the second end plate. The second spiral wrap is meshingly engaged with the first spiral wrap to form compression pockets. The injection passage is in fluid communication with the compression pockets. The fitting assembly is in fluid communication with the injection passage. The valve assembly coupled to one of the second scroll member and the fitting assembly and movable between a closed position in which fluid communication between the compression pockets and the suction chamber is prevented and an open position in which fluid communication between the compression pockets and the suction chamber is allowed.

21 Claims, 14 Drawing Sheets

(51) Int. Cl.

| | |
|---|---|
| ***F04C 14/24*** | (2006.01) |
| ***F04C 14/26*** | (2006.01) |
| ***F04C 28/24*** | (2006.01) |
| ***F04C 28/28*** | (2006.01) |
| ***F04C 29/12*** | (2006.01) |
| ***F25B 1/04*** | (2006.01) |
| ***F25B 31/02*** | (2006.01) |
| ***F25B 41/20*** | (2021.01) |

(52) U.S. Cl.
CPC ..... *F04C 18/0207* (2013.01); *F04C 18/0269* (2013.01); *F04C 28/24* (2013.01); *F04C 28/28* (2013.01); *F04C 29/04* (2013.01); *F04C 29/12* (2013.01); *F25B 31/026* (2013.01); *F25B 41/20* (2021.01)

(58) Field of Classification Search
CPC .. F04C 18/0215; F04C 18/02; F04C 18/0269; F04C 29/12; F04C 29/04
See application file for complete search history.

(56) References Cited

U.S. PATENT DOCUMENTS 4,382,370 A 5/1983 Suefuji et al.
4,383,805 A 5/1983 Teegarden et al.
4,431,388 A 2/1984 Eber et al.
4,475,360 A 10/1984 Suefuji et al.
4,497,615 A 2/1985 Griffith
4,505,651 A * 3/1985 Terauchi ..... F04C 28/16 417/440
4,557,675 A 12/1985 Murayama et al.
4,669,962 A 6/1987 Mizuno et al.
4,676,075 A 6/1987 Shiibayashi
4,696,627 A 9/1987 Asano et al.
4,767,293 A 8/1988 Caillat et al.
4,774,816 A 10/1988 Uchikawa et al.
4,818,195 A 4/1989 Murayama et al.
4,904,164 A 2/1990 Mabe et al.
4,904,165 A 2/1990 Fraser, Jr. et al.
4,940,385 A 7/1990 Gurth
4,940,395 A 7/1990 Yamamoto et al.
5,074,760 A 12/1991 Hirooka et al.
5,087,170 A 2/1992 Kousokabe et al.
5,156,539 A 10/1992 Anderson et al.
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,336,058 A 8/1994 Yokoyama
5,356,271 A 10/1994 Miura et al.
5,395,224 A 3/1995 Caillat et al.
5,451,146 A 9/1995 Inagaki et al.
5,469,716 A 11/1995 Bass et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,741,120 A 4/1998 Bass et al.
5,803,716 A 9/1998 Wallis et al.
5,810,573 A 9/1998 Mitsunaga et al.
5,833,442 A 11/1998 Park et al.
5,855,475 A 1/1999 Fujio et al.
5,885,063 A 3/1999 Makino et al.
5,993,171 A 11/1999 Higashiyama
5,993,177 A 11/1999 Terauchi et al.
5,996,364 A 12/1999 Lifson et al.
6,047,557 A 4/2000 Pham et al.
6,077,057 A 6/2000 Hugenroth et al.
6,086,335 A 7/2000 Bass et al.
6,102,671 A 8/2000 Yamamoto et al.
6,120,255 A 9/2000 Schumann et al.
6,123,517 A 9/2000 Brooke et al.
6,132,179 A 10/2000 Higashiyama
6,164,940 A 12/2000 Terauchi et al.
6,171,086 B1 1/2001 Lifson et al.
6,176,686 B1 1/2001 Wallis et al.
6,190,138 B1 2/2001 Hugenroth et al.
6,196,816 B1 3/2001 Lifson et al.
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,295,821 B1 10/2001 Madigan
6,299,417 B1 10/2001 Shin et al.
6,350,111 B1 2/2002 Perevozchikov et al.
6,406,279 B2 6/2002 Kohsokabe et al.
6,412,293 B1 7/2002 Pham et al.
6,413,058 B1 7/2002 Williams et al.
6,430,959 B1 8/2002 Lifson
6,454,551 B2 9/2002 Kuroki et al.
6,457,948 B1 10/2002 Pham
6,464,481 B2 10/2002 Tsubai et al.
6,506,036 B2 1/2003 Tsubai et al.
6,544,016 B2 4/2003 Gennami et al.
6,558,143 B2 5/2003 Nakajima et al.
6,589,035 B1 7/2003 Tsubono et al.
6,619,062 B1 * 9/2003 Shibamoto ..... F04C 29/126 62/228.3
6,679,683 B2 1/2004 Seibel et al.
6,769,888 B2 8/2004 Tsubono et al.
6,821,092 B1 11/2004 Gehret et al.
6,881,046 B2 4/2005 Shibamoto et al.
6,884,042 B2 4/2005 Zili et al.
6,984,114 B2 1/2006 Zili et al.
7,118,358 B2 10/2006 Tsubono et al.
7,137,796 B2 11/2006 Tsubono et al.
7,197,890 B2 4/2007 Taras et al.
7,228,710 B2 6/2007 Lifson
7,229,261 B2 6/2007 Morimoto et al.
7,278,832 B2 10/2007 Lifson et al.
7,326,039 B2 2/2008 Kim et al.
7,344,365 B2 3/2008 Takeuchi et al.
RE40,257 E 4/2008 Doepker et al.
7,354,259 B2 4/2008 Tsubono et al.
RE40,344 E 5/2008 Perevozchikov et al.
7,404,706 B2 7/2008 Ishikawa et al.
7,513,753 B2 4/2009 Shin et al.
7,547,202 B2 6/2009 Knapke
7,585,164 B2 9/2009 Joo et al.
7,611,345 B2 11/2009 Huang et al.
7,674,098 B2 3/2010 Lifson
7,717,687 B2 5/2010 Reinhart
7,771,178 B2 8/2010 Perevozchikov et al.
7,815,423 B2 10/2010 Guo et al.
7,967,582 B2 6/2011 Akei et al.
7,967,583 B2 6/2011 Stover et al.
7,972,125 B2 7/2011 Stover et al.
7,976,295 B2 7/2011 Stover et al.
7,976,296 B2 7/2011 Stover et al.
7,988,433 B2 8/2011 Akei et al.
7,988,434 B2 8/2011 Stover et al.
8,313,318 B2 11/2012 Stover et al.
8,475,140 B2 7/2013 Seibel et al.
8,517,704 B2 8/2013 Stover et al.
8,529,232 B2 9/2013 Stover et al.
8,568,118 B2 10/2013 Stover et al.
8,585,382 B2 11/2013 Akei et al.
8,616,014 B2 12/2013 Stover et al.
8,628,316 B2 1/2014 Stover et al.
8,790,098 B2 7/2014 Stover et al.
8,857,200 B2 10/2014 Stover et al.
9,127,677 B2 9/2015 Doepker

(56) References Cited

U.S. PATENT DOCUMENTS

| | | | | |
|---|---|---|---|---|
| 9,303,642 | B2 | 4/2016 | Akei et al. | |
| 9,494,157 | B2 | 11/2016 | Doepker | |
| 9,879,674 | B2 | 1/2018 | Akei et al. | |
| 10,066,622 | B2 | 9/2018 | Pax et al. | |
| 10,087,936 | B2 | 10/2018 | Pax et al. | |
| 2001/0010800 | A1 | 8/2001 | Kohsokabe et al. | |
| 2002/0028150 | A1 | 3/2002 | Kawabata et al. | |
| 2002/0039540 | A1 | 4/2002 | Kuroki et al. | |
| 2003/0012659 | A1 | 1/2003 | Seibel et al. | |
| 2004/0071571 | A1 | 4/2004 | Uchida et al. | |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0019178 | A1 | 1/2005 | Shin et al. | |
| 2005/0053507 | A1 | 3/2005 | Takeuchi et al. | |
| 2006/0165542 | A1 | 7/2006 | Sakitani et al. | |
| 2006/0269432 | A1 | 11/2006 | Lifson | |
| 2007/0036661 | A1 | 2/2007 | Stover | |
| 2007/0053782 | A1 | 3/2007 | Okamoto et al. | |
| 2007/0092390 | A1 | 4/2007 | Ignatiev et al. | |
| 2007/0130973 | A1 | 6/2007 | Lifson et al. | |
| 2007/0231172 | A1 | 10/2007 | Fujimura et al. | |
| 2007/0237664 | A1 | 10/2007 | Joo et al. | |
| 2007/0245892 | A1 | 10/2007 | Lemke et al. | |
| 2007/0269326 | A1 | 11/2007 | Seibel et al. | |
| 2008/0025861 | A1 | 1/2008 | Okawa et al. | |
| 2008/0107555 | A1 | 5/2008 | Lifson | |
| 2008/0159892 | A1 | 7/2008 | Huang et al. | |
| 2008/0196445 | A1 | 8/2008 | Lifson et al. | |
| 2008/0223057 | A1* | 9/2008 | Lifson | F04C 28/08 62/228.4 |
| 2008/0286118 | A1 | 11/2008 | Gu et al. | |
| 2009/0013701 | A1 | 1/2009 | Lifson et al. | |
| 2009/0068048 | A1 | 3/2009 | Stover et al. | |
| 2009/0071183 | A1 | 3/2009 | Stover et al. | |
| 2009/0074593 | A1 | 3/2009 | Joo et al. | |
| 2009/0110570 | A1 | 4/2009 | Cho | |
| 2009/0196781 | A1 | 8/2009 | Kiem et al. | |
| 2009/0297377 | A1 | 12/2009 | Stover et al. | |
| 2009/0297378 | A1 | 12/2009 | Stover et al. | |
| 2009/0297379 | A1 | 12/2009 | Stover et al. | |
| 2009/0297380 | A1 | 12/2009 | Stover et al. | |
| 2010/0111741 | A1 | 5/2010 | Chikano et al. | |
| 2010/0135836 | A1 | 6/2010 | Stover et al. | |
| 2010/0158731 | A1 | 6/2010 | Akei et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0033328 | A1 | 2/2011 | Stover et al. | |
| 2011/0052437 | A1* | 3/2011 | Iitsuka | F04C 28/26 418/55.1 |
| 2011/0103988 | A1 | 5/2011 | Stover et al. | |
| 2011/0256009 | A1 | 10/2011 | Stover et al. | |
| 2012/0009076 | A1* | 1/2012 | Kim | F04C 23/008 418/55.1 |
| 2012/0107163 | A1 | 5/2012 | Monnier et al. | |
| 2013/0081710 | A1* | 4/2013 | Ignatiev | F04C 29/045 137/565.01 |
| 2014/0134030 | A1 | 5/2014 | Stover et al. | |
| 2014/0134031 | A1 | 5/2014 | Doepker et al. | |
| 2014/0154121 | A1 | 6/2014 | Doepker | |
| 2014/0154124 | A1 | 6/2014 | Doepker et al. | |
| 2014/0356211 | A1 | 12/2014 | Stover et al. | |
| 2015/0330386 | A1 | 11/2015 | Doepker | |
| 2016/0025093 | A1 | 1/2016 | Doepker | |
| 2016/0076543 | A1 | 3/2016 | Akei et al. | |
| 2017/0241417 | A1 | 8/2017 | Jin et al. | |
| 2017/0342978 | A1 | 11/2017 | Doepker | |
| 2017/0342983 | A1 | 11/2017 | Jin et al. | |
| 2017/0342984 | A1 | 11/2017 | Jin et al. | |
| 2018/0149155 | A1 | 5/2018 | Akei et al. | |
| 2018/0216618 | A1 | 8/2018 | Jeong | |
| 2019/0353164 | A1 | 11/2019 | Berning et al. | |

FOREIGN PATENT DOCUMENTS

| | | | | |
|---|---|---|---|---|
| CN | 1061647 | A | 6/1992 | |
| CN | 1028379 | C | 5/1995 | |
| CN | 1137614 | A | 12/1996 | |
| CN | 1158945 | A | 9/1997 | |
| CN | 1289011 | A | 3/2001 | |
| CN | 1292850 | A | 4/2001 | |
| CN | 1088159 | C | 7/2002 | |
| CN | 1382912 | A | 12/2002 | |
| CN | 1434216 | A | 8/2003 | |
| CN | 1475673 | A | 2/2004 | |
| CN | 1576603 | A | 2/2005 | |
| CN | 1707104 | A | 12/2005 | |
| CN | 1800647 | A | 7/2006 | |
| CN | 2821233 | Y | 9/2006 | |
| CN | 1896518 | A | 1/2007 | |
| CN | 1908437 | A | 2/2007 | |
| CN | 1952398 | A | 4/2007 | |
| CN | 1963214 | A | 5/2007 | |
| CN | 1995756 | A | 7/2007 | |
| CN | 100334352 | C | 8/2007 | |
| CN | 100343521 | C | 10/2007 | |
| CN | 100523505 | C | 8/2009 | |
| DE | 3142744 | A1 | 6/1982 | |
| EP | 0144169 | A2 | 6/1985 | |
| EP | 0479421 | A1 | 4/1992 | |
| EP | 0747598 | A2 | 12/1996 | |
| EP | 1199474 | A2 | 4/2002 | |
| EP | 1241417 | A1 | 9/2002 | |
| EP | 1507085 | A1 | 2/2005 | |
| EP | 2307728 | B1 | 8/2016 | |
| JP | H01106990 | A | 4/1989 | |
| JP | H03081588 | A | 4/1991 | |
| JP | H03138473 | A | 6/1991 | |
| JP | H05001677 | A | 1/1993 | |
| JP | H05157061 | A * | 6/1993 | F04C 28/26 |
| JP | 2550612 | B2 | 11/1996 | |
| JP | 2000161263 | A | 6/2000 | |
| JP | 2001304144 | A | 10/2001 | |
| JP | 2007154761 | A | 6/2007 | |
| JP | 2008248775 | A | 10/2008 | |
| JP | 2008267707 | A | 11/2008 | |
| WO | WO-99031355 | A1 | 6/1999 | |
| WO | WO-2009155109 | A2 | 12/2009 | |
| WO | WO-2017071641 | A1 | 5/2017 | |
| WO | WO-2017130401 | A1 * | 8/2017 | F04C 18/02 |

OTHER PUBLICATIONS

English translation of WO2017130401 by PE2E Feb. 14, 2023.*

U.S. Appl. No. 15/881,016, filed Jan. 26, 2018, Masao Akei et al.

U.S. Appl. No. 16/154,844, filed Oct. 9, 2018, Jeffrey Lee Berning et al.

Luckevich, Mark, "MEMS microvalves: the new valve world." Valve World, May 2007, pp. 79-83.

International Search Report regarding International Application No. PCT/US2009/045630, dated Jan. 4, 2010.

Written Opinion of the International Searching Authority regarding International Application No. PCT/US2009/045630, dated Jan. 4, 2010.

International Search Report regarding International Application No. PCT/US2009/045666, dated Jan. 4, 2010.

Written Opinion of the International Searching Authority regarding International Application No. PCT/US2009/045666, dated Jan. 4, 2010.

International Search Report regarding International Application No. PCT/US2009/045665, dated Jan. 8, 2010.

Written Opinion of the International Searching Authority regarding International Application No. PCT/US2009/045665, dated Jan. 8, 2010.

International Search Report regarding International Application No. PCT/US2009/045672, dated Jan. 14, 2010.

Written Opinion of the International Searching Authority regarding International Application No. PCT/US2009/045672, dated Jan. 14, 2010.

(56) References Cited

OTHER PUBLICATIONS

International Search Report regarding International Application No. PCT/US2009/045638, dated Jan. 21, 2010.
Written Opinion of the International Searching Authority regarding International Application No. PCT/US2009/045638, dated Jan. 21, 2010.
International Search Report regarding International Application No. PCT/US2009/045647, dated Jan. 29, 2010.
Written Opinion of the International Searching Authority regarding International Application No. PCT/US2009/045647, dated Jan. 29, 2010.
International Search Report regarding International Application No. PCT/US2009/066551, dated May 31, 2010.
Written Opinion of the International Searching Authority regarding International Application No. PCT/US2009/066551, dated May 31, 2010.
International Search Report regarding International Application No. PCT/US2010/030248, dated Nov. 26, 2010.
Written Opinion of the International Searching Authority regarding International Application No. PCT/US2010/030248, dated Nov. 26, 2010.
International Search Report regarding International Application No. PCT/US2010/036593, dated Jan. 5, 2011.
Written Opinion of the International Searching Authority regarding International Application No. PCT/US2010/036593, dated Jan. 5, 2011.
International Search Report regarding International Application No. PCT/US2010/036586, dated Jan. 17, 2011.
Written Opinion of the International Searching Authority regarding International Application No. PCT/US2010/036586, dated Jan. 17, 2011.
Notice of Allowance regarding U.S. Appl. No. 12/474,736, dated Feb. 18, 2011.
Notice of Allowance regarding U.S. Appl. No. 12/474,954, dated Feb. 18, 2011.
Notice of Allowance regarding U.S. Appl. No. 12/474,868, dated Feb. 25, 2011.
Notice of Allowance regarding U.S. Appl. No. 12/474,633, dated Mar. 4, 2011.
Applicant-Initiated Interview Summary regarding U.S. Appl. No. 12/474,954, dated Mar. 10, 2011.
Notice of Allowance regarding U.S. Appl. No. 12/629,432, dated Mar. 10, 2011.
Notice of Allowance regarding U.S. Appl. No. 12/754,920, dated Mar. 22, 2011.
Notice of Allowance regarding U.S. Appl. No. 12/993,207, dated Mar. 22, 2011.
Restriction Requirement regarding U.S. Appl. No. 12/474,806, dated May 21, 2012.
Office Action regarding U.S. Appl. No. 12/474,806, dated Jun. 18, 2012.
Office Action regarding Korean Patent Application No. 10-2010-7028064, dated Jul. 30, 2012. Translation provided by Y.S. Chang & Associates.
Office Action regarding Korean Patent Application No. 10-2010-7029389, dated Sep. 26, 2012. Translation provided by Y.S. Chang & Associates.
Notice of Allowance regarding U.S. Appl. No. 12/474,806, dated Sep. 27, 2012.
Restriction Requirement regarding U.S. Appl. No. 13/165,306, dated Oct. 15, 2012.
Office Action regarding U.S. Appl. No. 13/181,065, dated Nov. 9, 2012.
Restriction Requirement regarding U.S. Appl. No. 13/367,950, dated Nov. 14, 2012.
Restriction Requirement regarding U.S. Appl. No. 12/909,303, dated Nov. 26, 2012.
Office Action regarding Chinese Patent Application No. 200980125355.0, dated Nov. 30, 2012. Translation provided by Unitalen Attorneys at Law.
Office Action regarding Chinese Patent Application No. 200980125442.6, dated Nov. 30, 2012. Translation provided by Unitalen Attorneys at Law.
Office Action regarding U.S. Appl. No. 13/165,306, dated Decembers, 2012.
Office Action regarding U.S. Appl. No. 12/788,786, dated Jan. 3, 2013.
Office Action regarding U.S. Appl. No. 12/909,303, dated Jan. 10, 2013.
Office Action regarding U.S. Appl. No. 13/367,950, dated Jan. 11, 2013.
Office Action regarding Chinese Patent Application No. 200980126965.2, dated Jan. 14, 2013. Translation provided by Unitalen Attorneys at Law.
Office Action regarding U.S. Appl. No. 13/167,192, dated Jan. 25, 2013.
Office Action regarding Chinese Patent Application No. 200980126961.4, dated Feb. 5, 2013. Translation provided by Unitalen Attorneys at Law.
Office Action regarding Korean Patent Application No. 10-2011-7026307, dated Feb. 22, 2013. Translation provided by Y.S. Chang & Associates.
Notice of Allowance regarding U.S. Appl. No. 13/181,065, dated Mar. 1, 2013.
Applicant-Initiated Interview Summary regarding U.S. Appl. No. 13/165,306, dated Mar. 5, 2013.
Office Action regarding Chinese Patent Application No. 200980126962.9, dated Apr. 2, 2013. Translation provided by Unitalen Attorneys at Law.
Notice of Allowance regarding U.S. Appl. No. 12/789,105, dated Apr. 12, 2013.
Notice of Allowance regarding U.S. Appl. No. 13/367,950, dated May 1, 2013.
Notice of Allowance regarding U.S. Appl. No. 12/909,303, dated May 13, 2013.
Office Action regarding Chinese Patent Application No. 200980125441.1, dated May 31, 2013. Translation provided by Unitalen Attorneys At Law.
Office Action regarding U.S. Appl. No. 13/167,192, dated Jun. 11, 2013.
Notice of Allowance regarding U.S. Appl. No. 12/788,786, dated Jun. 21, 2013.
Office Action regarding U.S. Appl. No. 13/165,306, dated Jun. 26, 2013.
Office Action regarding Chinese Patent Application No. 200980153925.7, dated Aug. 27, 2013. Translation provided by Unitalen Attorneys at Law.
Notice of Allowance regarding U.S. Appl. No. 13/167,192, dated Sep. 13, 2013.
Applicant-Initiated Interview Summary regarding U.S. Appl. No. 13/165,306, dated Sep. 18, 2013.
Notice of Allowance regarding U.S. Appl. No. 13/165,306, dated Sep. 27, 2013.
Office Action regarding Chinese Patent Application No. 201110256328.6, dated Nov. 4, 2013. Translation provided by Unitalen Attorneys at Law.
Office Action regarding Chinese Patent Application No. 201080020243.1, dated Novembers, 2013. Translation provided by Unitalen Attorneys At Law.
Office Action regarding Chinese Patent Application No. 200980126962.9, dated Nov. 28, 2013. Translation provided by Unitalen Attorneys at Law.
Office Action regarding U.S. Appl. No. 14/041,839, dated Dec. 13, 2013.
Office Action regarding Chinese Patent Application No. 201080023038.0, dated Dec. 17, 2013. Translation provided by Unitalen Attorneys At Law.
Office Action regarding Chinese Patent Application No. 201110324010.7, dated Dec. 19, 2013. Translation provided by Unitalen Attorneys at Law.
Office Action regarding Chinese Patent Application No. 201210039884.2, dated Jan. 20, 2014. Translation provided by Unitalen Attorneys at Law.

(56) References Cited

OTHER PUBLICATIONS

Office Action regarding Chinese Patent Application No. 201080023005.6, dated Feb. 7, 2014. Translation provided by Unitalen Attorneys at Law.
Notice of Allowance regarding U.S. Appl. No. 14/041,839, dated Jun. 6, 2014.
Office Action regarding Chinese Patent Application No. 201080023005.6, dated Aug. 18, 2014. Translation provided by Unitalen Attorneys At Law.
Search Report regarding European Patent Application No. 09767416.2, dated Mar. 20, 2015.
Office Action regarding U.S. Appl. No. 14/081,390, dated Mar. 27, 2015.
Search Report regarding European Patent Application No. 09767420.4, dated May 26, 2015.
Search Report regarding European Patent Application No. 09767415.4, dated Jun. 3, 2015.
Search Report regarding European Patent Application No. 10762374.6, dated Jun. 16, 2015.
Search Report regarding European Patent Application No. 09767410.5, dated Jun. 19, 2015.
Office Action regarding Chinese Patent Application No. 201410461048.2, dated Nov. 30, 2015. Translation provided by Unitalen Attorneys at Law.
Notice of Allowance regarding U.S. Appl. No. 14/081,390, dated Jan. 29, 2016.
Office Action regarding Chinese Patent Application No. 201410384996.0, dated Jan. 29, 2016. Translation provided by Unitalen Attorneys at Law.
Office Action regarding Chinese Patent Application No. 201410460792.0, dated Feb. 25, 2016. Translation provided by Unitalen Attorneys at Law.
Office Action regarding U.S. Appl. No. 14/462,224, dated Apr. 19, 2016.
Office Action regarding Chinese Patent Application No. 201410461048.2, dated Jul. 26, 2016. Translation provided by Unitalen Attorneys at Law.
Office Action regarding Chinese Patent Application No. 201410384996.0, dated Sep. 20, 2016. Translation provided by Unitalen Attorneys at Law.
Office Action regarding Chinese Patent Application No. 201410460792.0, dated Oct. 21, 2016. Translation provided by Unitalen Attorneys At Law.
Search Report regarding European Patent Application No. 10781281.0, dated Dec. 7, 2016.
Search Report regarding European Patent Application No. 10781283.6, dated Jan. 4, 2017.
Office Action regarding Chinese Patent Application No. 201410384996.0, dated Mar. 7, 2017. Translation provided by Unitalen Attorneys at Law.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Office Action regarding Indian Patent Application No. 1129/MUMNP/2011, dated May 19, 2017.
Office Action regarding Indian Patent Application No. 2480/MUMNP/2010, dated May 26, 2017.
Office Action regarding Indian Patent Application No. 2482/MUMNP/2010, dated Jul. 11, 2017.
Office Action regarding Indian Patent Application No. 2043/MUMNP/2011, dated Jul. 28, 2017.
Office Action regarding Indian Patent Application No. 2481/MUMNP/2010, dated Aug. 16, 2017.
Office Action regarding Indian Patent Application No. 2479/MUMNP/2010, dated Aug. 23, 2017.
Notice of Allowance regarding U.S. Appl. No. 14/946,824, dated Oct. 25, 2017.
Office Action regarding Chinese Patent Application No. 201410460792.0, dated Nov. 1, 2017. Translation provided by Unitalen Attorneys At Law.
Office Action regarding Indian Patent Application No. 2117/MUMNP/2011, dated Dec. 15, 2017.
Office Action regarding Indian Patent Application No. 2119/MUMNP/2011, dated Jan. 23, 2018.
Office Action regarding European Patent Application No. 10781283.6, dated Mar. 6, 2018.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Indian Patent Application No. 2119/MUMNP/2011, dated Oct. 18, 2019.
Office Action regarding Indian Patent Application No. 2043/MUMNP/2011, dated Nov. 27, 2019.
Office Action regarding U.S. Appl. No. 15/881,016, dated Jan. 23, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Restriction Requirement regarding U.S. Appl. No. 16/154,844, dated Jul. 2, 2020.
Office Action regarding U.S. Appl. No. 15/881,016, dated Jul. 21, 2020.
Office Action regarding U.S. Appl. No. 16/154,844, dated Oct. 5, 2020.

* cited by examiner

CLIMATE-CONTROL SYSTEM HAVING VALVE ASSEMBLY

CROSS-REFERENCE TO RELATED APPLICATIONS

This application claims the benefit of U.S. Provisional Application No. 62/816,626, filed on Mar. 11, 2019. The entire disclosure of the above application is incorporated herein by reference.

FIELD

The present disclosure relates to a climate-control system having a valve assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices, and one or more compressors circulating a working fluid (e.g., refrigerant or carbon dioxide) through the fluid circuit. Efficient and reliable operation of the climate-control system is desirable to ensure that the climate-control system is capable of effectively and efficiently providing a cooling and/or heating effect on demand.

SUMMARY

This section provides a general summary of the disclosure, and is not a comprehensive disclosure of its full scope or all of its features.

In one form, the present disclosure discloses a compressor includes a shell, first and second scroll members, a fluid-injection fitting assembly and a valve assembly. The shell defines a suction chamber. The first scroll member is disposed within the shell and includes a first end plate having a first spiral wrap extending therefrom. The second scroll member is disposed within the shell and includes a second end plate having a second spiral wrap extending therefrom and an injection passage formed in the second end plate. The second spiral wrap is meshingly engaged with the first spiral wrap to form compression pockets. The injection passage being in fluid communication with a radially intermediate one of the compression pockets. The fluid-injection fitting assembly is at least partially disposed within the shell and in fluid communication with the injection passage. The fluid-injection fitting assembly is configured to provide working fluid to the radially intermediate one of the compression pockets. The valve assembly is coupled to one of the second scroll member and the fluid-injection fitting assembly and movable between a closed position in which fluid communication between the radially intermediate one of the compression pockets and the suction chamber is prevented and an open position in which fluid communication between the radially intermediate one of the compression pockets and the suction chamber is allowed. The valve assembly is movable from the closed position to the open position when a fluid pressure in the radially intermediate one of the compression pockets exceeds a predetermined threshold value.

In some configurations of the compressor of the above paragraph, the fluid-injection fitting assembly includes a scroll fitting and a transfer conduit attached to the scroll fitting. The valve assembly is coupled to the scroll fitting.

In some configurations of the compressor of any one or more of the above paragraphs, the valve assembly includes a valve housing, a valve body, and a spring that biases the valve body toward the closed position. The valve body is movable relative to the valve housing from the closed position to the open position when fluid pressure in the radially intermediate one of the compression pockets exceeds the predetermined threshold value.

In some configurations of the compressor of any one or more of the above paragraphs, working fluid in the radially intermediate one of the compression pockets flows to a passage formed in the scroll fitting and out an aperture formed in the valve housing into the suction chamber when the valve body is movable from the closed position to the open position.

In some configurations of the compressor of any one or more of the above paragraphs, the predetermined threshold value is greater than or equal to 500 psi.

In some configurations of the compressor of any one or more of the above paragraphs, the valve assembly is coupled to the second end plate of the second scroll member.

In some configurations of the compressor of any one or more of the above paragraphs, the valve assembly includes a valve housing, a valve body, and a spring that biases the valve body toward the closed position. The valve body is movable relative to the valve housing from the closed position to the open position when a fluid pressure in the radially intermediate one of the compression pockets exceeds the predetermined threshold value.

In some configurations of the compressor of any one or more of the above paragraphs, working fluid in the radially intermediate one of the compression pockets flows to the injection passage and out an aperture formed in an end cap of the valve assembly into the suction chamber when the valve body is movable from the closed position to the open position.

In some configurations of the compressor of any one or more of the above paragraphs, the predetermined threshold value is greater than or equal to 500 psi.

In some configurations of the compressor of any one or more of the above paragraphs, a passage is formed in the second end plate of the second scroll member and is in fluid communication with the radially intermediate one of the compression pockets.

In some configurations of the compressor of any one or more of the above paragraphs, the valve assembly includes a valve housing, a valve body, and a spring that biases the valve body toward the closed position. The valve body is movable relative to the valve housing from the closed position to the open position when a fluid pressure in the radially intermediate one of the compression pockets exceeds the predetermined threshold value.

In some configurations of the compressor of any one or more of the above paragraphs, working fluid in the radially intermediate one of the compression pockets flows to the passage and out an aperture formed in an end cap of the valve assembly into the suction chamber when the valve body is movable from the closed position to the open position.

In some configurations of the compressor of any one or more of the above paragraphs, the injection passage and the fluid-injection fitting assembly cooperate to define a fluid circuit. Fluid communication between the radially intermediate one of the compression pockets and the suction chamber via the fluid circuit is allowed when the valve assembly is in the open position.

In another form, the present disclosure discloses a compressor including a shell, first and second scroll members, a fluid-injection fitting assembly and a valve assembly. The shell defines a suction chamber. The first scroll member is disposed within the shell and includes a first end plate having a first spiral wrap extending therefrom. The second scroll member is disposed within the shell and includes a second end plate having a second spiral wrap extending therefrom and an injection passage formed in the second end plate. The second spiral wrap is meshingly engaged with the first spiral wrap to form compression pockets. The injection passage is in fluid communication with a radially intermediate one of the compression pockets. The fluid-injection fitting assembly is at least partially disposed within the shell and in fluid communication with the injection passage. The fluid-injection fitting assembly is configured to provide working fluid to the radially intermediate one of the compression pockets. The valve assembly is coupled to the fluid-injection fitting assembly and movable between a closed position in which fluid communication between the radially intermediate one of the compression pockets and the suction chamber is prevented and an open position in which fluid communication between the radially intermediate one of the compression pockets and the suction chamber is allowed. The valve assembly is movable from the closed position to the open position when a pressure difference of working fluid in the radially intermediate one of the compression pockets and working fluid in the suction chamber exceeds a predetermined threshold value.

In some configurations of the compressor of the above paragraph, the fluid-injection fitting assembly includes a scroll fitting and a transfer conduit attached to the scroll fitting. The valve assembly is coupled to the scroll fitting.

In some configurations of the compressor of any one or more of the above paragraphs, the valve assembly includes a valve flap that is movable relative to the scroll fitting from the closed position to the open position when the pressure difference of working fluid in the radially intermediate one of the compression pockets and working fluid in the suction chamber exceeds the predetermined threshold value.

In some configurations of the compressor of any one or more of the above paragraphs, working fluid in the radially intermediate one of the compression pockets flows to a first passage formed in the scroll fitting and out a second passage formed in the scroll fitting into the suction chamber when the valve flap is movable from the closed position to the open position.

In some configurations of the compressor of any one or more of the above paragraphs, the second passage extends perpendicular to the first passage.

In some configurations of the compressor of any one or more of the above paragraphs, the fluid-injection fitting assembly includes a scroll fitting and a transfer conduit attached to the scroll fitting. The valve assembly is coupled to the transfer conduit.

In some configurations of the compressor of any one or more of the above paragraphs, the valve assembly includes a valve flap that is movable relative to the transfer conduit from the closed position to the open position when the pressure difference of working fluid in the radially intermediate one of the compression pockets and working fluid in the suction chamber exceeds the predetermined threshold value.

In some configurations of the compressor of any one or more of the above paragraphs, working fluid in the radially intermediate one of the compression pockets flows through a first passage formed in the scroll fitting and out an aperture formed in the transfer conduit into the suction chamber when the valve flap is movable from the closed position to the open position.

In some configurations of the compressor of any one or more of the above paragraphs, the injection passage and the fluid-injection fitting assembly cooperate to define a fluid circuit. Fluid communication between the radially intermediate one of the compression pockets and the suction chamber via the fluid circuit is allowed when the valve assembly is in the open position.

In yet another form, the present disclosure discloses a compressor including a shell, first and second scroll members, a fluid-injection fitting assembly and a valve assembly. The shell defines a suction chamber. The first scroll member is disposed within the shell and includes a first end plate having a first spiral wrap extending therefrom and a venting passage formed in the first end plate. The second scroll member is disposed within the shell and includes a second end plate having a second spiral wrap extending therefrom and an injection passage formed in the second end plate. The second spiral wrap is meshingly engaged with the first spiral wrap to form compression pockets. The injection passage and the venting passage is in fluid communication with a radially intermediate one of the compression pockets. The fluid-injection fitting assembly is at least partially disposed within the shell and in fluid communication with the injection passage. The fluid-injection fitting assembly is configured to provide working fluid to the radially intermediate one of the compression pockets. The valve assembly is coupled to the first end plate and movable between a closed position in which fluid communication between the radially intermediate one of the compression pockets and the suction chamber is prevented and an open position in which fluid communication between the radially intermediate one of the compression pockets and the suction chamber is allowed. The valve assembly is movable from the closed position to the open position when a fluid pressure within the radially intermediate one of the compression pockets exceeds a predetermined threshold value.

In some configurations of the compressor of the above paragraph, the valve assembly includes a valve housing, a valve body, and a spring that biases the valve body toward the closed position. The valve body is movable relative to the valve housing from the closed position to the open position when the fluid pressure in the radially intermediate one of the compression pockets exceeds the predetermined threshold value.

In some configurations of the compressor of any one or more of the above paragraphs, working fluid in the radially intermediate one of the compression pockets flows to the venting passage and out an aperture formed in an end cap of the valve assembly into the suction chamber when the valve body is movable from the closed position to the open position.

In some configurations of the compressor of any one or more of the above paragraphs, the predetermined threshold value is greater than or equal to 500 psi.

In yet another form, the present disclosure discloses a climate-control system including a compressor, a first fluid passageway, a second fluid passageway, a conduit and a valve. The compressor defines a suction chamber and includes a first inlet, a second inlet and a compression mechanism forming a compression pocket. The first inlet is in fluid communication with the suction chamber. The second inlet is in fluid communication with the compression pocket. The first fluid passageway includes a first heat exchanger. The first fluid passageway provides working fluid from the first heat exchanger to the first inlet. The second fluid passageway extends between a second heat exchanger and the second inlet. The second fluid passageway provides working fluid from the second heat exchanger to the second inlet. The conduit extends from the first fluid passageway to the second fluid passageway. The valve is disposed along the conduit and movable between a closed position in which fluid communication between the compression pocket and the suction chamber via the conduit is prevented and an open position in which fluid communication between the compression pocket and the suction chamber via the conduit is allowed. The valve is movable from the closed position to the open position when a fluid pressure in the compression pocket exceeds a predetermined threshold value.

In some configurations of the climate-control system of the above paragraph, the predetermined threshold value is greater than or equal to 500 psi.

In some configurations of the climate-control system of any one or more of the above paragraphs, the conduit extends from the first fluid passageway at a location between the first inlet and the first heat exchanger to the second fluid passageway at a location between the second heat exchanger and the second inlet.

In some configurations of the climate-control system of any one or more of the above paragraphs, the first heat exchanger is an evaporator and the second heat exchanger is a condenser.

In some configurations of the climate-control system of any one or more of the above paragraphs, working fluid in the compression pocket flows through the conduit, the first inlet and into the suction chamber when the valve is moved from the closed position to the open position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
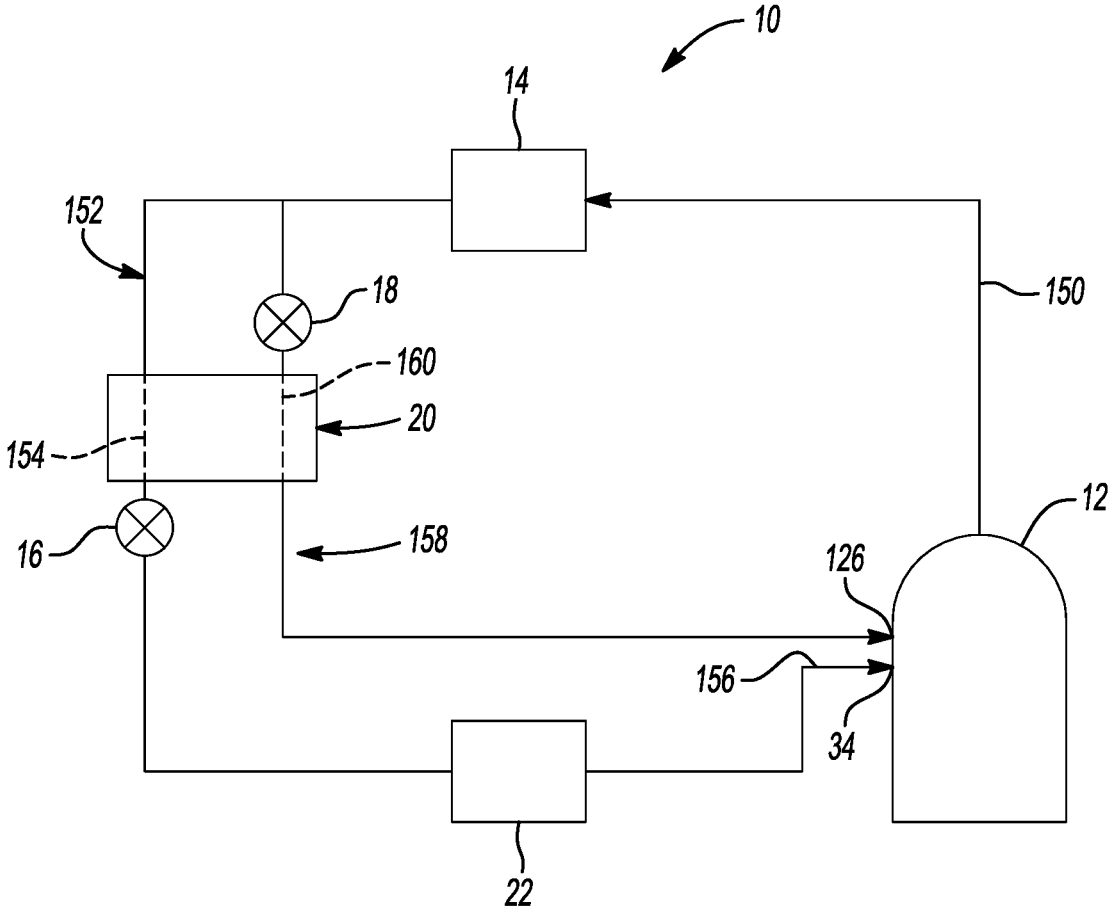
FIG. 1 is a schematic representation of a climate-control system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a fluid-circuit having a compressor 12, a first heat exchanger 14 (an outdoor heat exchanger such as a condenser or gas cooler, for example), first and second expansion devices 16, 18, a second heat exchanger 20 and a third heat exchanger 22 (an indoor heat exchanger such as an evaporator). The compressor 12 may pump working fluid (e.g., refrigerant, carbon dioxide, etc.) through the circuit.

Figure 2:
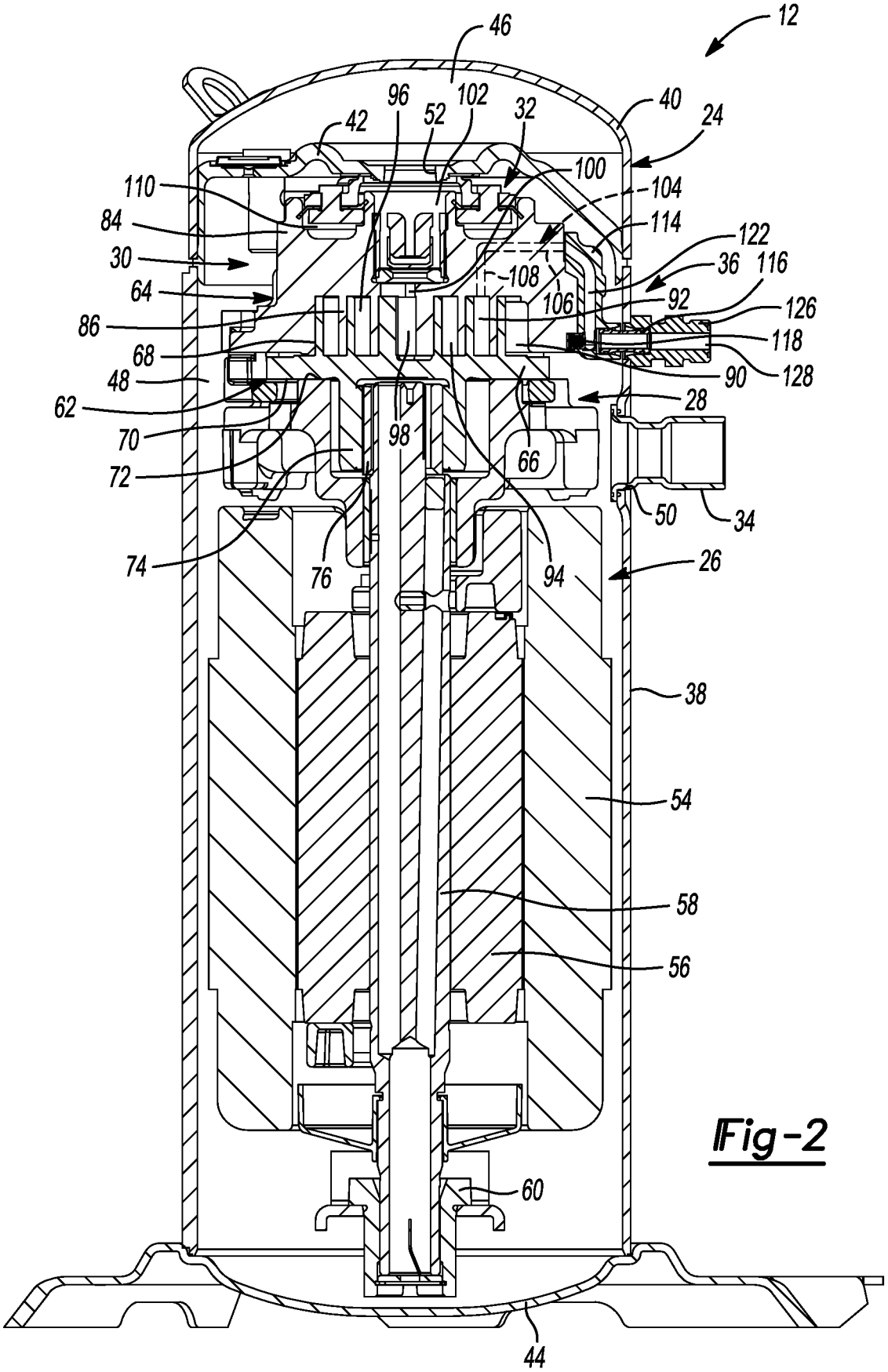
FIG. 2 is a cross-sectional view of a compressor of the climate-control system of FIG. 1.
Figure 3:
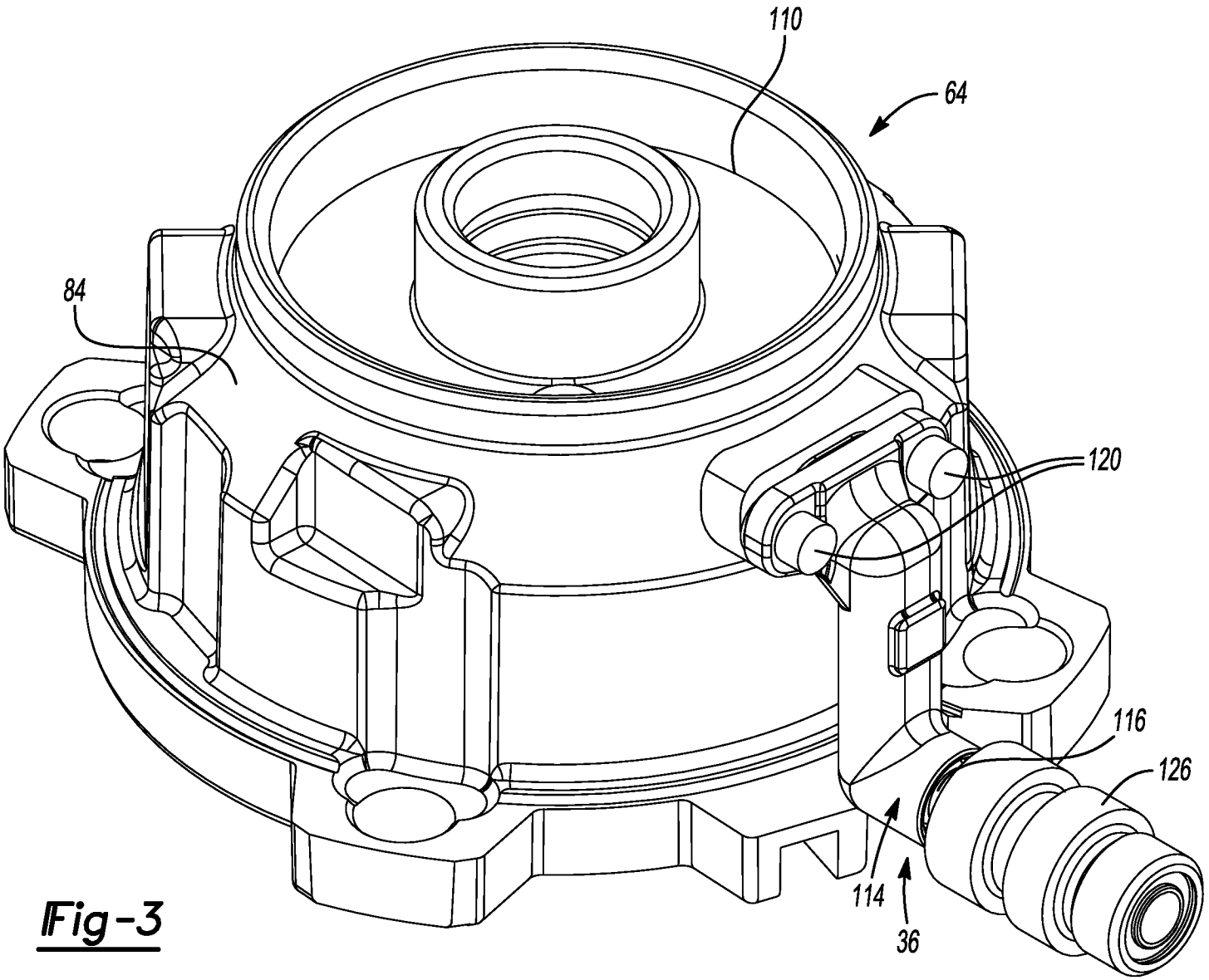
FIG. 3 is a perspective view of a non-orbiting scroll of the compression mechanism and a fluid-injection fitting assembly.

As shown in FIG. 2, the compressor 12 may be a low-side compressor (i.e., a compressor in which the motor assembly is disposed within a suction chamber or suction-pressure region of the compressor), for example. The compressor 12 may include a hermetic shell assembly 24, a motor assembly 26, a main bearing housing 28, a compression mechanism 30, a seal assembly 32, a suction gas inlet fitting 34 (e.g., a first inlet of the compressor 12) and a fluid-injection fitting assembly 36 (e.g., a second inlet of the compressor 12).

The shell assembly 24 may generally form a compressor housing and may include a cylindrical shell 38, an end cap 40 at an upper end thereof, a transversely extending muffler plate 42 and a base 44 at a lower end thereof. The end cap 40 and the muffler plate 42 may generally define a discharge chamber 46, while the cylindrical shell 38, the muffler plate 42 and the base 44 may generally define a suction chamber 48. A discharge fitting (not shown) may be attached to the shell assembly 24 at an opening (not shown) in the end cap 40 and may be in fluid communication with the first heat exchanger 14. The suction gas inlet fitting 34 may be attached to the shell assembly 24 at an opening 50 such that the suction gas inlet fitting 34 is in fluid communication with the third heat exchanger 22. The muffler plate 42 may include a discharge passage 52 extending therethrough that provides communication between the compression mechanism 30 and the discharge chamber 46.

The motor assembly 26 may generally include a motor stator 54, a rotor 56 and a driveshaft 58. The motor stator 54 may be fixedly coupled with shell 38 (e.g., press-fit into the shell 38). The driveshaft 58 may be rotatably driven by the rotor 56. The rotor 56 may be press-fit onto the driveshaft 58.

The main bearing housing 28 may be affixed to the shell 38 at a plurality of points in any desirable manner, such as staking, for example, and may axially support the compression mechanism 30. The main bearing housing 28 may include a bearing that rotatably supports one end of the driveshaft 58. The other end of the driveshaft 58 may be supported by a lower bearing housing 60.

As shown in FIG. 2, the compression mechanism 30 may generally include an orbiting scroll or first scroll member 62 and a non-orbiting scroll or second scroll member 64. The orbiting scroll 62 may include an endplate 66 having a spiral vane or wrap 68 on the upper surface thereof and an annular flat thrust surface 70 on the lower surface. The thrust surface 70 may interface with the annular flat thrust bearing surface 72 on the main bearing housing 28. A cylindrical hub 74 may project downwardly from the thrust surface 70 and may have a drive bushing 76 rotatably disposed therein. The drive bushing 76 may include an inner bore in which the driveshaft 58 is drivingly disposed. An Oldham coupling may be engaged with the orbiting and non-orbiting scrolls 62, 64 to prevent relative rotation therebetween.

The non-orbiting scroll 64 may include an endplate 84 having a spiral wrap 86 on a lower surface thereof. The spiral wrap 86 may form a meshing engagement with the wrap 68 of the orbiting scroll 62, thereby creating compression pockets, including an inlet pocket 90 (i.e., a radially outer pocket), intermediate pockets 92, 94, 96 (i.e., radially intermediate pockets), and an outlet pocket 98 (i.e., a radially inner pocket). The non-orbiting scroll 64 may include a discharge passage 100 in communication with the outlet pocket 98 and an upwardly open recess 102. The upwardly open recess 102 may be in fluid communication with the discharge chamber 46 via the discharge passage 52 in the muffler plate 42.

The endplate 84 may include a fluid-injection passage 104 formed therein. The fluid-injection passage 104 may be in fluid communication with the fluid-injection fitting assembly 36 and with one or more of the intermediate pockets 92, 94, 96, and may include a radially extending portion 106 and an axially extending portion 108. The fluid-injection passage 104 may allow working fluid from the fluid-injection fitting assembly 36 to flow into the one or more of the intermediate pockets 92, 94, 96. The non-orbiting scroll 64 may include an annular recess 110 in the upper surface thereof.

As shown in FIG. 2, the seal assembly 32 may be located within the annular recess 110. In this way, the seal assembly 32 may be axially displaceable within the annular recess 110 relative to the shell assembly 24 and/or the non-orbiting scroll 64 to provide for axial displacement of the non-orbiting scroll 64 while maintaining a sealed engagement with the muffler plate 42 to isolate the discharge chamber 46 from the suction chamber 48. More specifically, in some configurations, pressure within the annular recess 110 may urge the seal assembly 32 into engagement with the muffler plate 42, and the spiral wrap 86 of the non-orbiting scroll 64 into engagement with the endplate 66 of the orbiting scroll 62, during normal compressor operation.

With reference to FIGS. 2-6, the fluid-injection fitting assembly 36 may include a scroll fitting 114, a transfer conduit 116, a valve assembly 118 (FIGS. 2 and 4-6), and a shell fitting 126. The scroll fitting 114 may be at least partially disposed in the shell 38 and may be attached to the non-orbiting scroll 64 via bolts 120. The scroll fitting 114 may include a passage 122 that is in fluid communication with the injection passage 104 at a first end and in fluid communication with the transfer conduit 116 and the valve assembly 118 at a second end. A sealing member 124 (e.g., a gasket) is disposed between the non-orbiting scroll 64 and the scroll fitting 114 to prevent leakage from or into the injection passage 104 and/or the scroll fitting 114.

Figure 4:
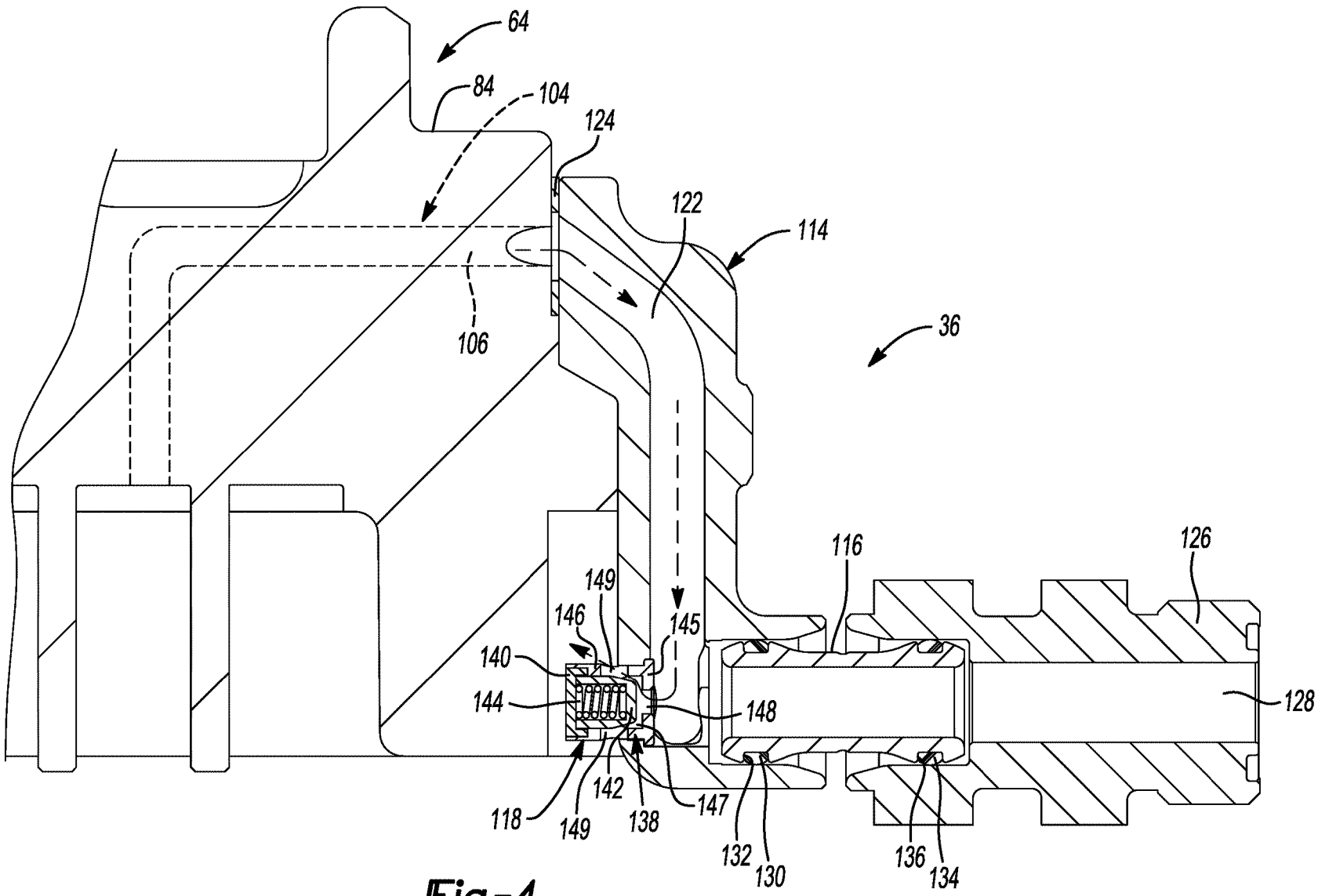
FIG. 4 is a partial cross-sectional view of the fluid-injection fitting assembly of FIG. 3 having a valve assembly in an open position.
Figure 5:
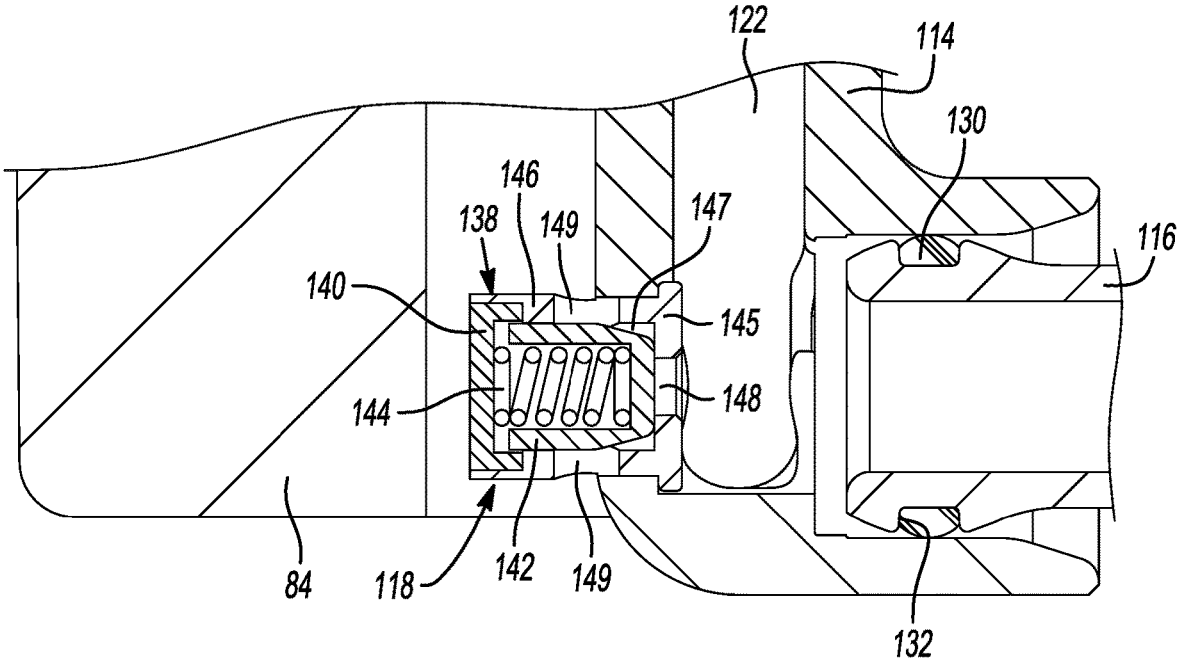
FIG. 5 is a cross-sectional view of the valve assembly in the closed position.
Figure 6:
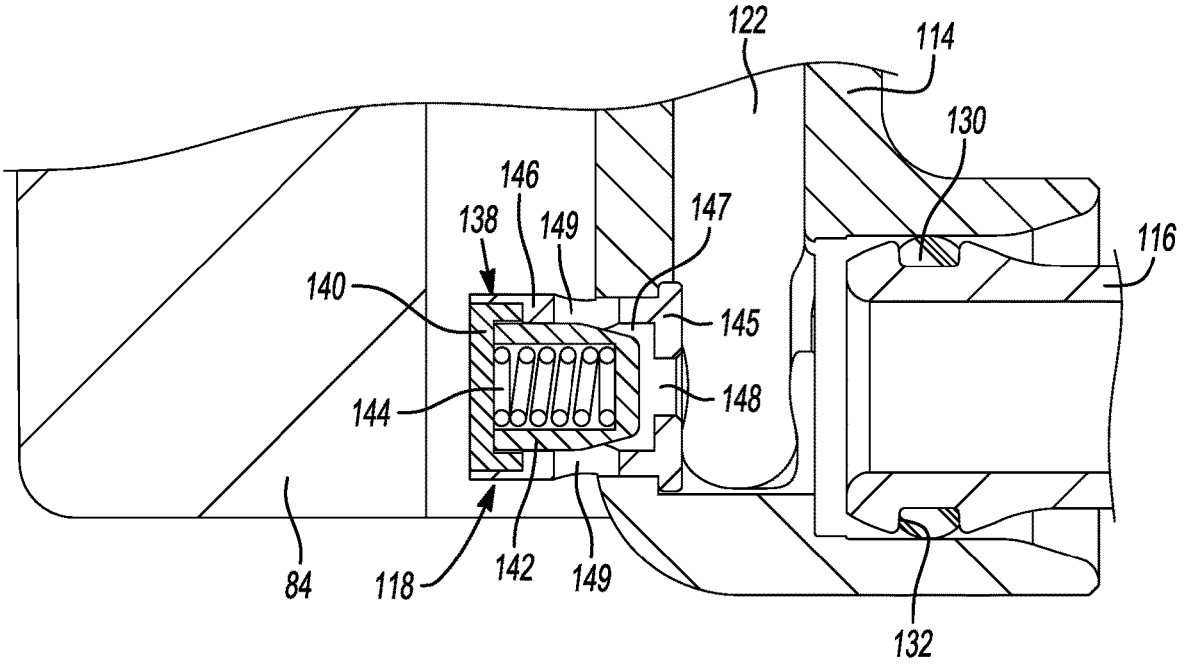
FIG. 6 is a cross-sectional view of the valve assembly in the open position.

As shown in FIG. 2, the shell fitting 126 (i.e., a second inlet) is attached to the shell 38 at an opening thereof. The transfer conduit 116 may be at least partially disposed in the shell 38 and may be attached to the scroll fitting 114 at a first end and to the shell fitting 126 at a second end. The transfer conduit 116 may be in fluid communication with the passage 122 of the scroll fitting 114 at the first end and may be in fluid communication with a passage 128 of the shell fitting 126 at the second end. With reference to FIGS. 4-6, a first sealing member 130 (e.g., an O-ring) may be disposed in a groove 132 formed in the transfer conduit 116 at or near the first end and a second sealing member 134 (e.g., an O-ring) may be disposed in a groove 136 formed in the transfer conduit 116 at or near the second end. In this way, the first and second sealing members 130, 134 prevent leakage from or into the transfer conduit 116, the scroll fitting 114 and/or the shell fitting 126. In some configurations, the transfer conduit 116 could be integrally formed with or a part of the scroll fitting 114 or the shell fitting 126.

As shown in FIGS. 2 and 4-6, the valve assembly 118 may include a valve housing 138, an end cap 140 a valve body 142 and a coiled spring 144. The valve housing 138 may be fixedly coupled to the scroll fitting 114 and may include an end wall 145 and a sidewall 146 that cooperate to define a valve-housing passage 147. The end wall 145 may define a first opening 148 and the sidewall 146 may define second openings 149. The first opening 148 is in fluid communication with the passage 122 of the scroll fitting 114 and also selectively in fluid communication with the second openings 149 via the valve-housing passage 147. The second openings 149 may be in fluid communication with the suction chamber 48 and selectively in fluid communication with the valve-housing passage 147. The end cap 140 is attached to the valve housing 138 at an end opposite the end wall 145.

The valve body 142 and the coiled spring 144 are disposed in the valve-housing passage 147 of the valve housing 138. The valve body 142 may be disposed within the valve-housing passage 147 and movable relative to the valve housing 138 between a closed position and an open position. In the closed position (FIG. 5), the valve body 142 may sealingly engage the end wall 145 to prevent fluid communication between the first opening 148 and the valve-housing passage 147. In the open position (FIG. 6), the valve body 142 may be spaced apart from the end wall 145, thereby allowing fluid communication between the first opening 148 and the valve-housing passage 147. The coiled spring 144 is connected to the end cap 140 and the valve body 142, and biases the valve body 142 into the closed position.

While the compressor 12 is described above as a low-side scroll compressor (i.e., a compressor in which the motor assembly is disposed within a suction-pressure chamber within the shell), in some configurations, the compressor 12 could be a high-side compressor (i.e., a compressor in which the motor assembly is disposed within a discharge-pressure chamber within the shell). For example, the compressor 12 could be a high-side or low-side compressor and could be a rotary, reciprocating, or screw compressor, or any other suitable type of compressor.

With reference back to FIG. 1, the first heat exchanger 14 may be in fluid communication with the compressor 12 and may receive compressed working fluid from the compressor 12 via a discharge line 150 that is connected to the discharge fitting (not shown) of the compressor 12. The first heat exchanger 14 may transfer heat from the compressed working fluid to ambient air that may be forced over the first heat exchanger 14. In some configurations, the first heat exchanger 14 may transfer heat from the compressed working fluid to a stream of liquid such as water, for example.

From the first heat exchanger 14, a first portion of the working fluid may flow to a first fluid passageway 152. The first fluid passageway 152 may include the first expansion device 16 (e.g., an expansion valve or capillary tube), a first conduit 154 of the second heat exchanger 20, and the third heat exchanger 22. The working fluid in the first fluid passageway 152 flows through the conduit 154 of the second heat exchanger 20 and the first expansion device 16 where its temperature and pressure are lowered. The working fluid then flows to the third heat exchanger 22 where the working fluid may absorb heat from a space to be cooled. From the third heat exchanger 22, the working fluid flows to the suction gas inlet fitting 34 (via a suction line 156) to be compressed by the compression mechanism 30.

A second portion of the working fluid from the first heat exchanger 14 may flow to a second fluid passageway 158 (e.g., a fluid-injection passageway). The second fluid passageway 158 may include the second expansion device 18 (e.g., an expansion valve or capillary tube) and a conduit 160 of the second heat exchanger 20. The working fluid in the second fluid passageway 158 may flow through the second expansion device 18 where its pressure is lowered. The working fluid then flows through the conduit 160 of the second heat exchanger 20 where it absorbs heat from the working fluid flowing through the conduit 154. The working fluid then flows to the fluid-injection fitting assembly 36 and into the intermediate pocket 92 of the compression mechanism 30 (via the injection passage 104). In this manner, the second fluid passageway 158, the fluid-injection fitting assembly 36, and the injection passage 104 may define a fluid-injection circuit. In some configurations, the second heat exchanger 20 may be a counter-flow heat exchanger as oppose to a parallel-flow heat exchanger. In some configurations, the system 10 may not include the second heat exchanger 20, e.g., if liquid injection (as opposed to vapor injection) is desired.

When the compressor 12 is in an OFF-mode, the compressor 12 may experience a flooded start condition. A flooded start condition is a condition where working fluid in a liquid phase (i.e., a mixture of gaseous and liquid working fluid or entirely liquid working fluid) may migrate into or otherwise be present in the compression pockets 90, 92, 94, 96, 98 of the compression mechanism 30 when the compressor 12 is switched from the OFF-mode to an ON-mode. During a flooded start condition, high fluid pressure (e.g., fluid pressures greater than or equal to 500 pounds per square inch (psi)) may be generated in the compression pockets 90, 92, 94, 96, 98 when the compression mechanism 30 compresses working fluid in the compression pockets 90, 92, 94, 96, 98 that is at least partially in liquid phase.

During normal operation of the system 10, intermediate-pressure working fluid may flow through the fluid-injection circuit from the second fluid passageway 158, through the fluid-injection fitting assembly 36, through the injection passage 104 and into the intermediate compression pocket 92). If the high pressure working fluid in the compression pocket 92 and/or the fluid-injection circuit exceeds a predetermined threshold value (e.g., during a flooded start condition), the coiled spring 144 of the valve assembly 118 will compress, thereby moving the valve body 142 from the closed position (FIG. 5) to the open position (FIG. 6). Once the valve body 142 is moved from the closed position to the open position, high pressure working fluid in the compression pocket 92 and/or the fluid-injection circuit (e.g., the passage 122) flows through the first opening 148, the valve-housing passage 147, and out the second openings 149 into the suction chamber 48.

It should be understood that the coiled spring 144 may compress in response to high pressure working fluid in the compression pocket 92 being above a predetermined threshold value due to the compressor 12 experiencing a flooded start condition and not during normal operation of the system 10. Stated another way, fluid pressures in the compression pocket 92 and in the fluid-injection circuit during normal operation of the system 10 are below the predetermined threshold value that causes the spring 144 to compress and the valve body 142 to move from the closed position to the open position.

One of the benefits of the climate-control system 10 of the present disclosure is the reduction of pressure of the high pressure working fluid generated during a flooded start condition, which increases the reliability of the compressor 12. That is, a flooded start condition may be detrimental to the reliability of the compressor 12 and, in turn, the efficient operation of the climate-control system 10. By reducing the pressure of the high pressure working fluid generated during a flooded start condition, the compressor 12 is more reliable, which allows for efficient operation of the climate-control system 10.

Another benefit of the climate-control system 10 of the present disclosure is the prevention of damage to the gasket 124 and the reduction of moment on the fitting 114 due to venting excessively high pressure working fluid to the suction chamber 48. This allows the gasket 124 to maintain a proper seal between the scroll 64 and the fitting 114.

Figure 7:
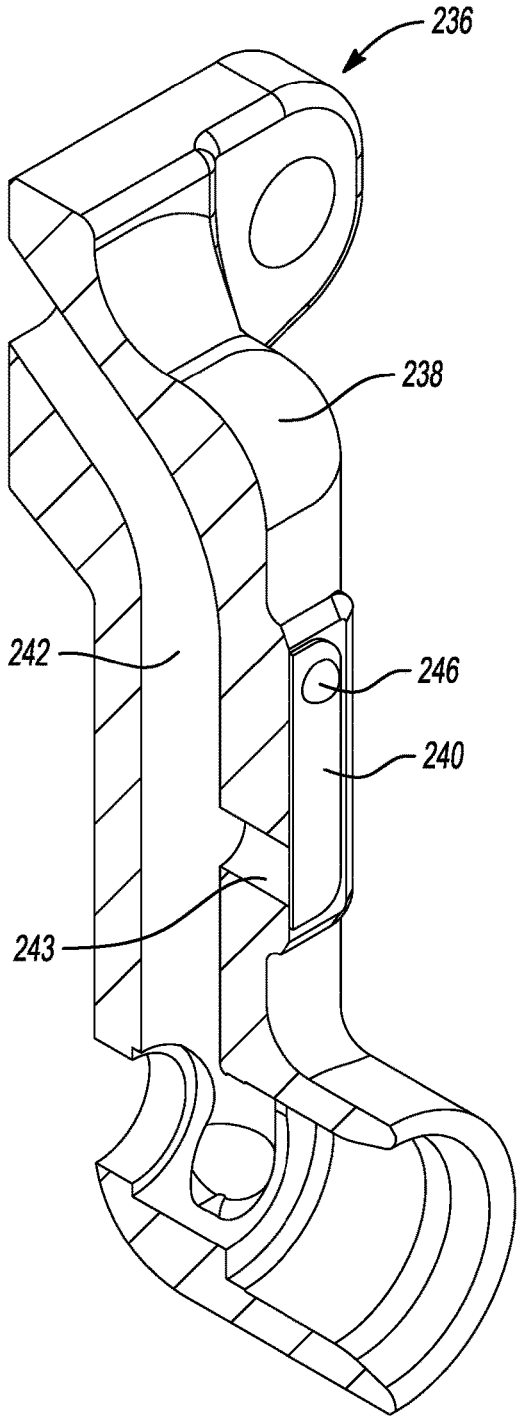
FIG. 7 is a partial cross-sectional view of an alternate fluid-injection fitting assembly having a valve assembly in a closed position.
Figure 8:
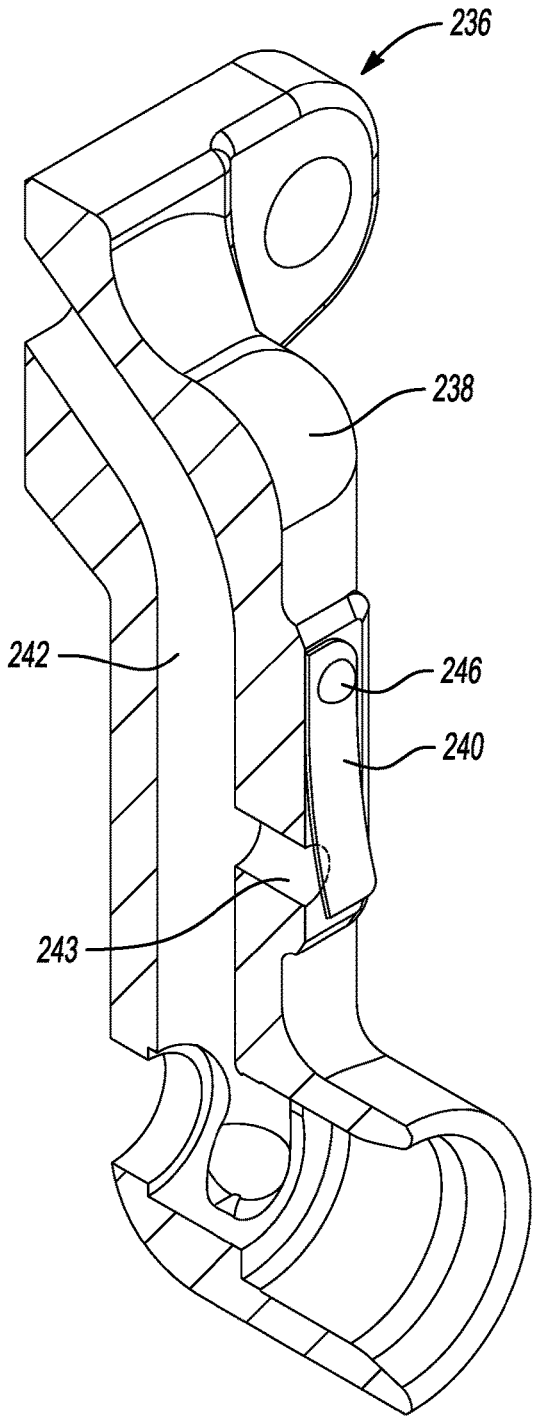
FIG. 8 is a partial cross-sectional view of the fluid-injection fitting assembly of FIG. 7 with the valve assembly in an open position.

With reference to FIGS. 7-8, another fluid-injection fitting assembly 236 is provided. The fluid-injection fitting assembly 236 may be incorporated into the compressor 12 instead of the fluid-injection fitting assembly 36. The structure and function of the fluid-injection fitting assembly 236 may be similar or identical to that of the fluid-injection fitting assembly 36 described above, apart from any exception noted below.

The fluid-injection fitting assembly 236 may include a scroll fitting 238, a valve flap 240 and a transfer conduit (not shown). The scroll fitting 238 may be at least partially disposed in the shell 38 and may be attached to the non-orbiting scroll 64 via bolts (not shown). The scroll fitting 238 may include a first passage 242 and a second passage 243. The first passage 242 may be in fluid communication with the injection passage 104 at a first end and in fluid communication the transfer conduit at a second end. The second passage 243 may be in fluid communication with the first passage 242 and in selective fluid communication with the suction chamber 48.

The valve flap 240 may be movably mounted to the scroll fitting 238 (via fasteners 246; only one shown in FIGS. 7 and 8) between a closed position (FIG. 7) and an open position (FIG. 8). In the closed position, the valve flap 240 may be sealingly engaged with the scroll fitting 238 to prevent fluid communication between the first passage 242 and the suction chamber 48. In the open position, the valve flap 240 may be spaced apart from the scroll fitting 238, thereby allowing fluid communication between the first passage 242 and the suction chamber 48 (via the second passage 243).

High pressure working fluid in the compression pocket 92 may flow at least partially through a fluid-injection circuit (the fluid-injection circuit may be defined by the injection passage 104, the passages 242, 243 of the scroll fitting 238, the transfer conduit (not shown), the shell fitting 126 and the second fluid passageway 158). If a pressure difference between high pressure working fluid in the compression pockets 90, 92, 94, 96, 98 (and/or the fluid-injection circuit) and working fluid in the suction chamber 48 exceeds a predetermined threshold, the valve flap 240 moves from the closed position to the open position. Once the valve flap 240 is moved from the closed position to the open position, high pressure working fluid in the compression pocket 92 and/or the fluid-injection circuit (e.g., the passages 242, 243) is vented out into the suction chamber 48. The valve flap 240 moves from the open position back to the closed position once the pressure difference between the high pressure working fluid in the compression pockets 90, 92, 94, 96, 98 (and/or the fluid-injection circuit) and the working fluid in the suction chamber 48 is below the predetermined threshold.

The structure and function of the transfer conduit (not shown) may be similar or identical to that of the transfer conduit 116 described above, and therefore, will not be described again in detail.

It should be understood that the valve flap 240 may move from the closed position to the open position in response to a pressure difference between high pressure working fluid in the compression pockets 90, 92, 94, 96, 98 (and/or the fluid-injection circuit) and working fluid in the suction chamber 48 exceeding a predetermined threshold value due to the compressor 12 experiencing a flooded start condition and not during normal operation of the system 10. Stated another way, the pressure difference between high pressure working fluid in the compression pockets 90, 92, 94, 96, 98 (and/or the fluid-injection circuit) and working fluid in the suction chamber 48 during normal operation of the compressor 12 is below the predetermined threshold value and would not cause the valve flap 240 to move from the closed position to the open position.

Figure 9:
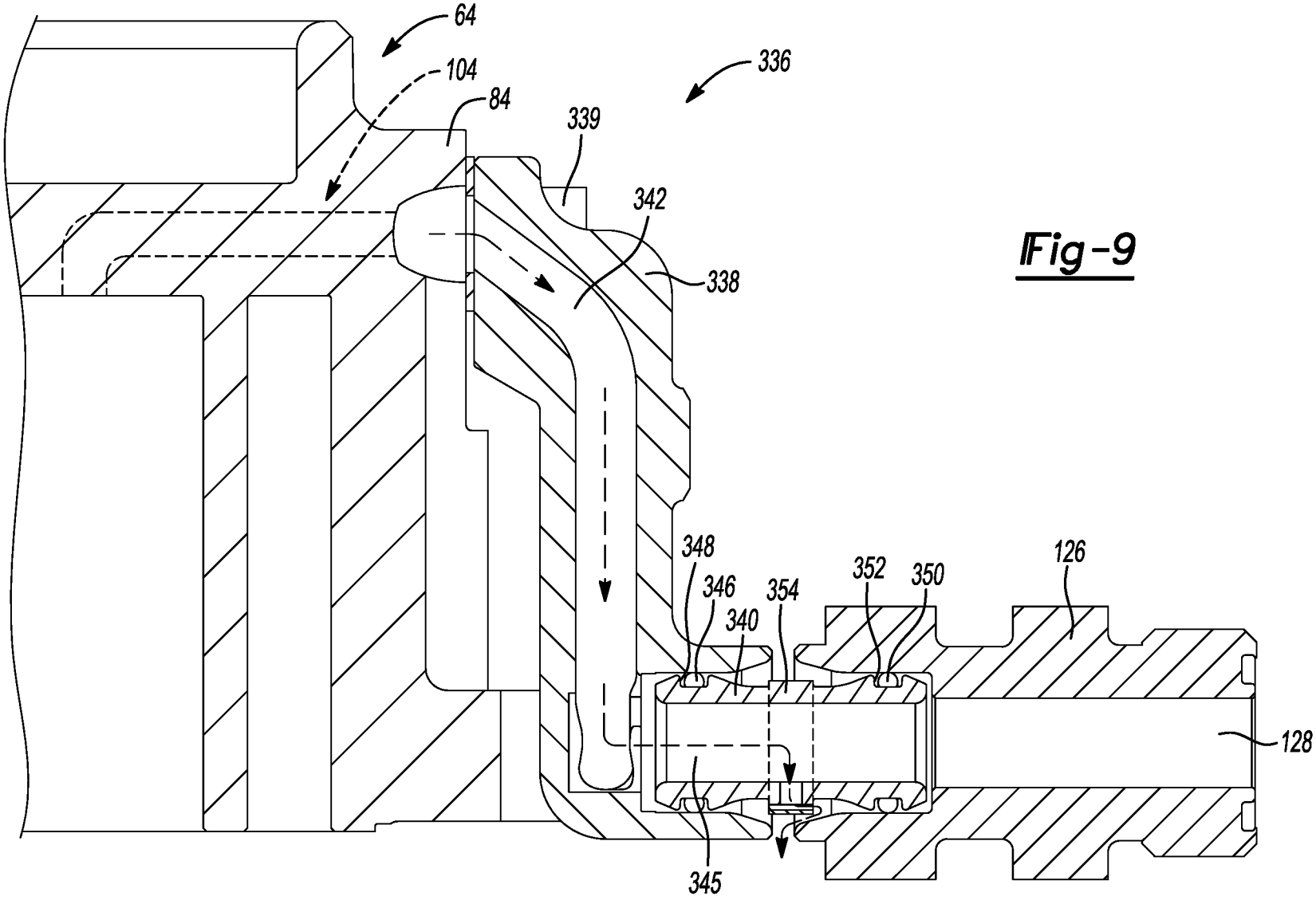
FIG. 9 is a partial cross-sectional view of yet another alternate fluid-injection fitting assembly.
Figure 10:
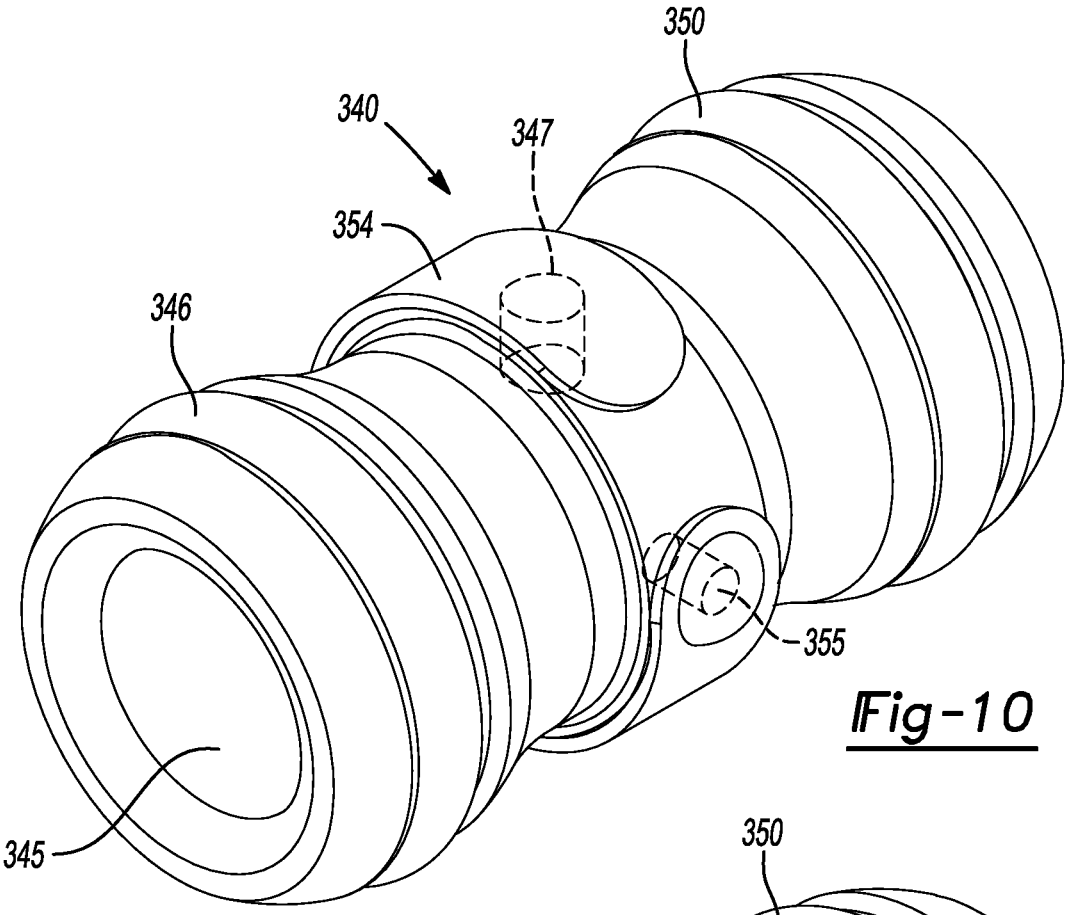
FIG. 10 is a perspective view of a transfer conduit of the fluid-injection fitting assembly of FIG. 9 having a valve assembly in a closed position.
Figure 11:
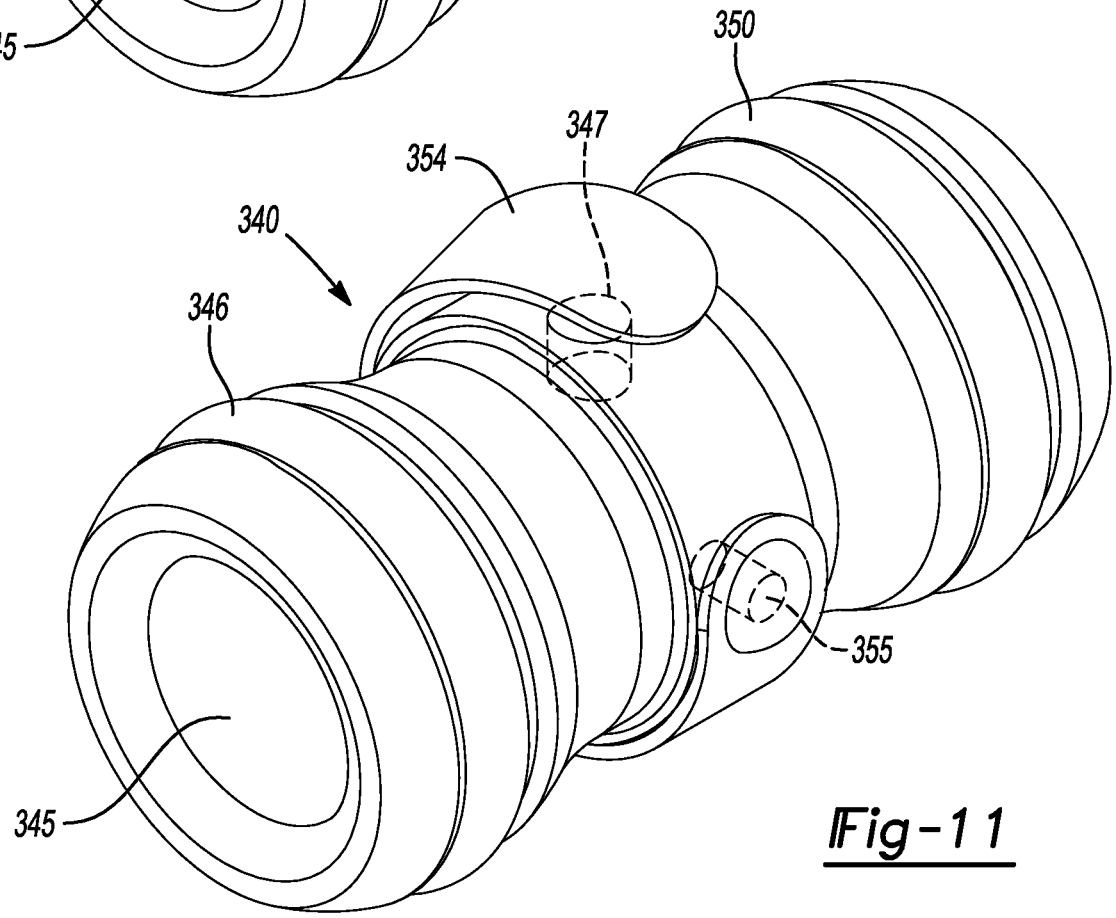
FIG. 11 is a perspective view of the transfer conduit of the fluid-injection fitting assembly of FIG. 9 having the valve assembly in an open position.

With reference to FIGS. 9-11, another fluid-injection fitting assembly 336 is provided. The fluid-injection fitting assembly 336 may be incorporated into the compressor 12 instead of the fluid-injection fitting assemblies 36, 236. The structure and function of the fluid-injection fitting assembly 336 may be similar or identical to that of the fluid-injection fitting assemblies 36, 236 described above, apart from any exception noted below.

The fluid-injection fitting assembly 336 may include a scroll fitting 338 and a transfer conduit 340. The scroll fitting 338 may be at least partially disposed in the shell 38 and may be attached to the non-orbiting scroll 64 via bolts 339. The scroll fitting 338 may include a fluid passage 342 that may be in fluid communication with the injection passage 104 at a first end and in fluid communication with the transfer conduit 340 at a second end.

The transfer conduit 340 may be at least partially disposed in the shell 38 and may be attached to the scroll fitting 338 at a first end and to the shell fitting 126 at a second end. A passage 345 of the transfer conduit 340 may be in fluid communication with the fluid passage 342 of the scroll fitting 338 at the first end and may be in fluid communication with the passage 128 of the shell fitting 126 at the second end. A first sealing member 346 (e.g., an O-ring) may be disposed in a groove 348 formed in the transfer conduit 340 at or near the first end and a second sealing member 350 (e.g., an O-ring) may be disposed in a groove 352 formed in the transfer conduit 340 at or near the second end. In this way, the first and second sealing members 346, 350 prevent leakage from or into the transfer conduit 340, the scroll fitting 338 and/or the shell fitting 126.

The fluid-injection fitting assembly 336 also includes a valve flap 354 that may be movably mounted to the transfer conduit 340 (via a fastener 355) between a closed position (FIG. 10) and an open position (FIG. 11). In the closed position, the valve flap 354 may be sealingly engaged with the transfer conduit 340 to prevent fluid communication between the passage 345 and the suction chamber 48. In the open position, the valve flap 354 may be spaced apart from the transfer conduit 340, thereby allowing fluid communication between the passage 345 and the suction chamber 48 via an aperture 347 in the transfer conduit 340.

As shown in FIG. 9, high pressure working fluid in the compression pocket 92 may flow at least partially through a fluid-injection circuit (the fluid-injection circuit may be defined by the injection passage 104, the passage 342 of the scroll fitting 338, the passage 345 of the transfer conduit 340, the passage 128 of the shell fitting 126 and the second fluid passageway 158). If a pressure difference between high pressure working fluid in the compression pockets 90, 92, 94, 96, 98 (and/or the fluid-injection circuit) and working fluid in the suction chamber 48 exceeds a predetermined threshold, the valve flap 354 moves from the closed position to the open position. Once the valve flap 354 is moved from the closed position to the open position, high pressure working fluid in the compression pocket 92 and/or the fluid-injection circuit (e.g., the passage 345) is vented out into the suction chamber 48. The valve flap 354 moves from the open position back to the closed position once the pressure difference between high pressure working fluid in the compression pockets 90, 92, 94, 96, 98 (and/or the fluid-injection circuit) and working fluid in the suction chamber 48 is below the predetermined threshold.

Figure 12:
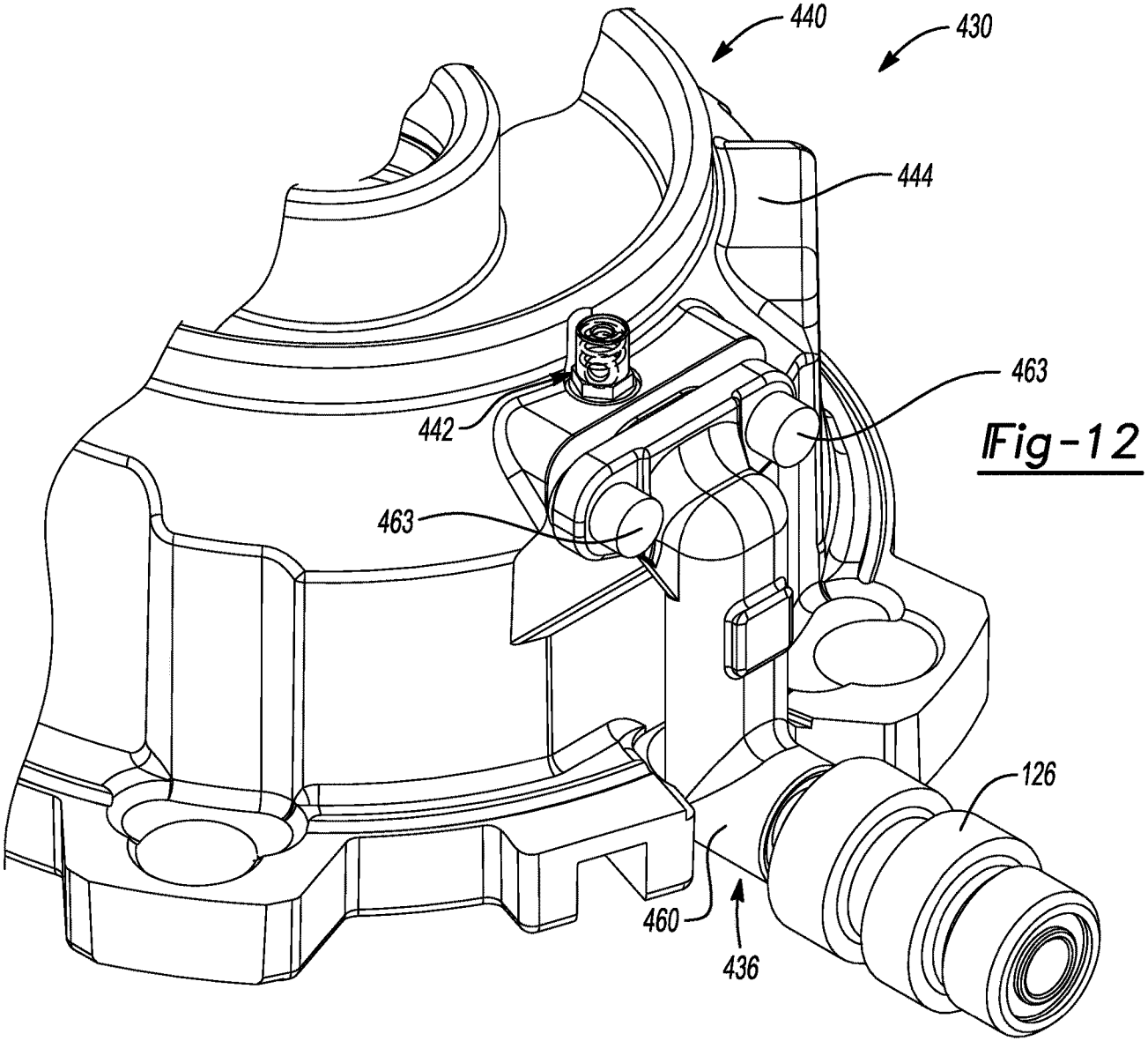
FIG. 12 is a partial perspective view of an alternate non-orbiting scroll and an alternate fluid-injection fitting assembly.
Figure 13:
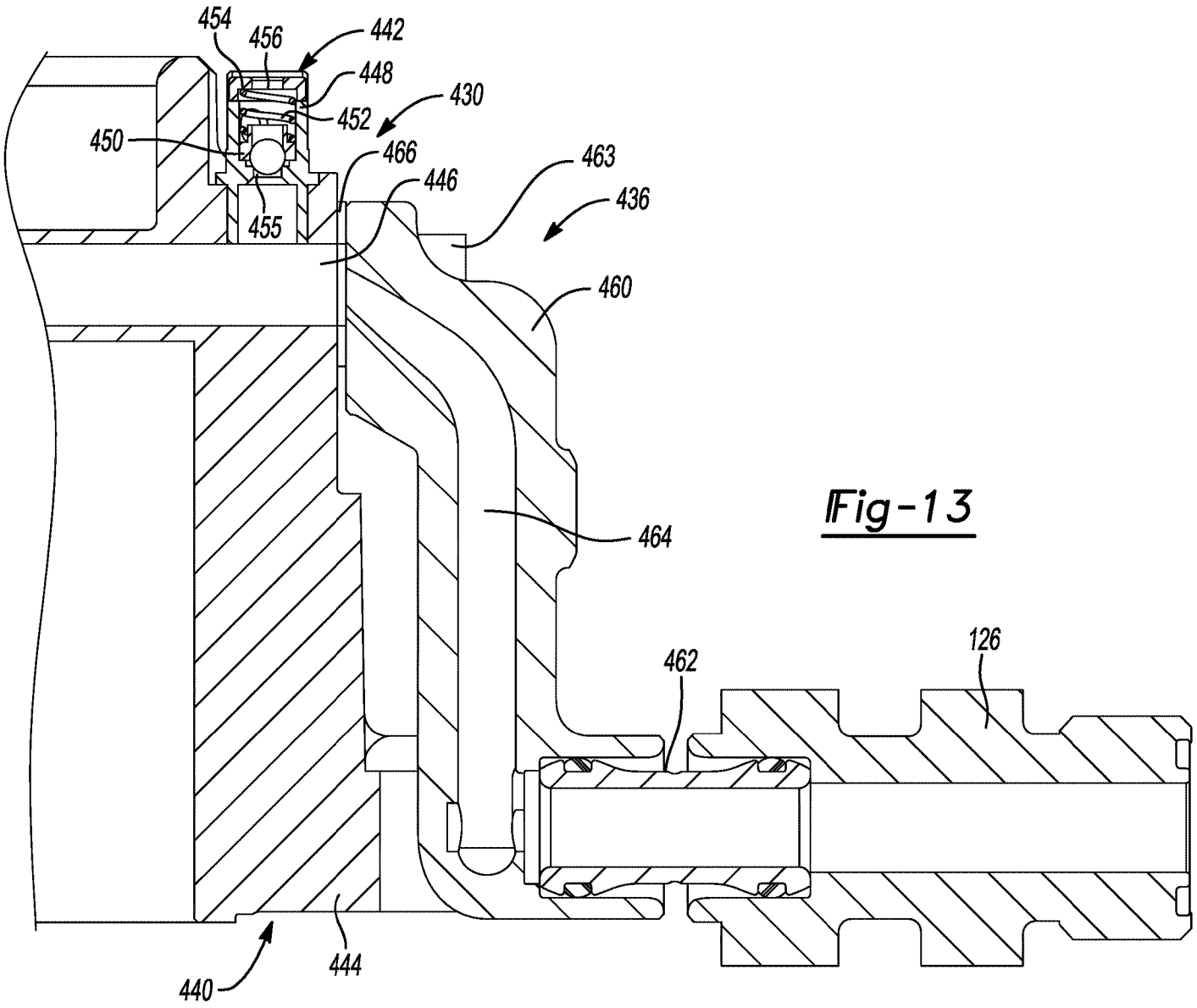
FIG. 13 is a partial cross-sectional view of the non-orbiting scroll and fluid-injection fitting assembly of FIG. 12.

With reference to FIGS. 12-13, another compression mechanism 430 and fluid-injection fitting assembly 436 are provided. The compression mechanism 430 may be incorporated into the compressor 12 instead of the compression mechanism 30 described above. The structure and function of the compression mechanism 430 may be similar or identical to that of the compression mechanism 30 described above, apart from any exception noted below.

The compression mechanism 430 may generally include an orbiting scroll or first scroll member (not shown), a non-orbiting scroll or second scroll member 440 and a valve assembly 442. The structure and function of the orbiting scroll may be similar or identical to that of the orbiting scroll 62 described above, and therefore, will not be described again in detail.

The non-orbiting scroll 440 may include an endplate 444 having a spiral wrap (not shown) projecting downwardly from the endplate 444. The spiral wrap may form a meshing engagement with the wrap (not shown) of the orbiting scroll, thereby creating compression pockets (not shown). The endplate 444 may include an injection passage 446 formed therein. The injection passage 446 may be in fluid communication with the fluid-injection fitting assembly 436 and one or more of the intermediate pockets of the compression pockets. The injection passage 446 may also be in selective fluid communication with the suction chamber 48 via the valve assembly 442. The injection passage 446 may allow working fluid from fluid-injection fitting assembly 436 to flow into the one or more of the intermediate pockets.

The valve assembly 442 may include a valve housing 448, a valve body 450, a coiled spring 452 and an end cap 454. The valve housing 448 may be coupled to the end plate 444 of the non-orbiting scroll 440. The valve body 450 may be disposed within the valve housing 448 and may be translatable between a closed position and an open position. In the closed position, the valve body 450 may prevent fluid communication between the injection passage 446 and the suction chamber 48. In the open position, the valve body 450 may allow fluid communication between the injection passage 446 and the suction chamber 48 (via openings 455, 456 in the valve housing 448 and the end cap 454, respectively). The coiled spring 452 is connected to the end cap 454 and the valve body 450, and biases the valve body 450 into the closed position. The end cap 454 is coupled to an end of the valve housing 448.

The fluid-injection fitting assembly 436 may be incorporated into the compressor 12 instead of the fluid-injection fitting assemblies 36, 236, 336 described above. The structure and function of the fluid-injection fitting assembly 436 may be similar or identical to that of the fluid-injection fitting assemblies 36, 236, 336 described above, apart from any exception noted below.

The fluid-injection fitting assembly 436 may include a scroll fitting 460 and a transfer conduit 462. The scroll fitting 460 may be at least partially disposed in the shell 38 and may be attached to the non-orbiting scroll 440 via bolts 463. The scroll fitting 460 may include a passage 464 that is in fluid communication with the injection passage 446 at a first end and in fluid communication with the transfer conduit 462 at a second end. A sealing member 466 (e.g., a gasket) is disposed between the non-orbiting scroll 440 and the scroll fitting 460 to prevent leakage from or into the injection passage 446 and/or the scroll fitting 460.

The structure and function of the transfer conduit 462 may be similar or identical to the transfer conduit 116 described above, and therefore, will not be described again in detail.

High pressure working fluid in an intermediate compression pocket may flow at least partially through a fluid-injection circuit (the fluid-injection circuit may be defined by the injection passage 446, the passage 464 of the scroll fitting 460, the transfer conduit 462, the shell fitting 126 and the second fluid passageway 158). If fluid pressures in the compression pockets and the fluid-injection circuit exceeds a predetermined threshold value, the coiled spring 452 of the valve assembly 442 will compress, thereby moving the valve body 450 from the closed position to the open position. Once the valve body 450 is moved from the closed position to the open position, high pressure working fluid in the intermediate compression pocket and/or the fluid-injection circuit (e.g., the passage 446) flows through the valve housing 448 and into the suction chamber 48.

Figure 14:
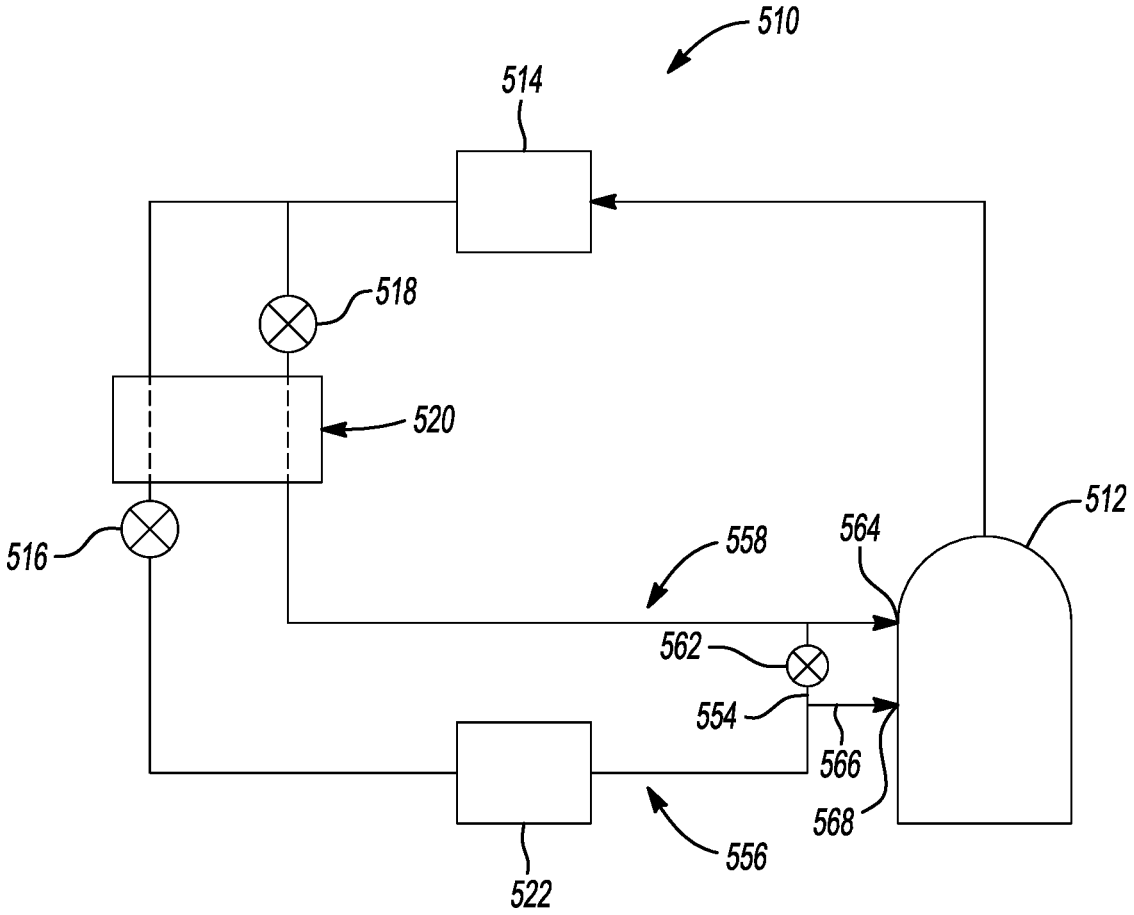
FIG. 14 is a schematic representation of an alternate climate-control system according to the principles of the present disclosure.

With reference to FIG. 14, another climate-control system 510 is provided. The structure and function of the climate control system 510 may be similar or identical to that of climate-control system 10 described above, apart from any exception noted below.

The climate-control system 510 may include a fluid-circuit having a compressor 512, a first heat exchanger 514 (an outdoor heat exchanger such as a condenser or gas cooler, for example), first and second expansion devices 516, 518, a second heat exchanger 520 and a third heat exchanger 522 (an indoor heat exchanger such as an evaporator). The structure and the function of the compressor 512, the first heat exchanger 514, the first and second expansion devices 516, 518, the second heat exchanger 520 and the third heat exchanger 522 may be similar or identical to that of the compressor 12, the first heat exchanger 14, the first and second expansion devices 16, 18, the second heat exchanger 20 and the third heat exchanger 22, respectively, described above, and therefore, will not be described again in detail.

The climate-control system 510 may also include a conduit 554 extending between a first fluid passageway 556 and a second fluid passageway 558. The first fluid passageway 556 may include the first expansion device 516 and the third heat exchanger 522, and the second fluid passageway 558 may include the second expansion device 518.

A valve 562 (e.g., a pressure-relief valve) may be disposed along the conduit 554 and may vent high pressure working fluid generated in an intermediate compression pocket (not shown) of the compression mechanism (not shown) of the compressor 512 to a suction chamber (not shown) of the compressor 512. That is, if fluid pressures in the compression pockets due to the compressor 512 experiencing a flooded start condition exceeds a predetermined threshold value, the valve 562 will open and the high pressure working fluid may flow through a second inlet 564 (i.e., a fluid-injection fitting assembly), through the conduit 554 and into the suction chamber (via a suction line 566 and first inlet 568 (i.e., suction inlet gas fitting)). It should be understood that during normal operation of the system 510, fluid pressures are below the predetermined threshold value, and thus, the valve 562 is in the closed position.

Figure 15:
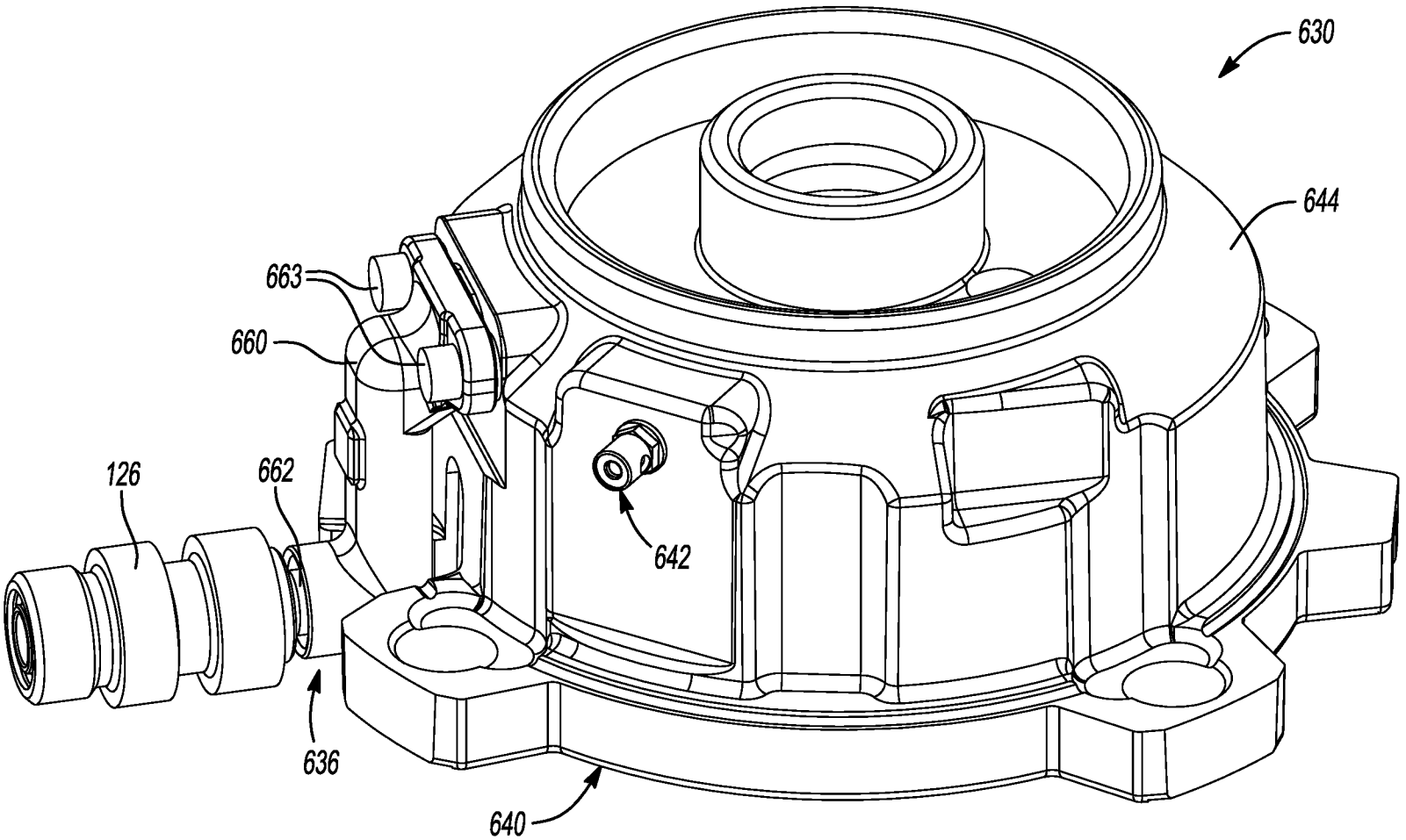
FIG. 15 is a perspective view of another alternate non-orbiting scroll and an alternate fluid-injection fitting assembly.
Figure 16:
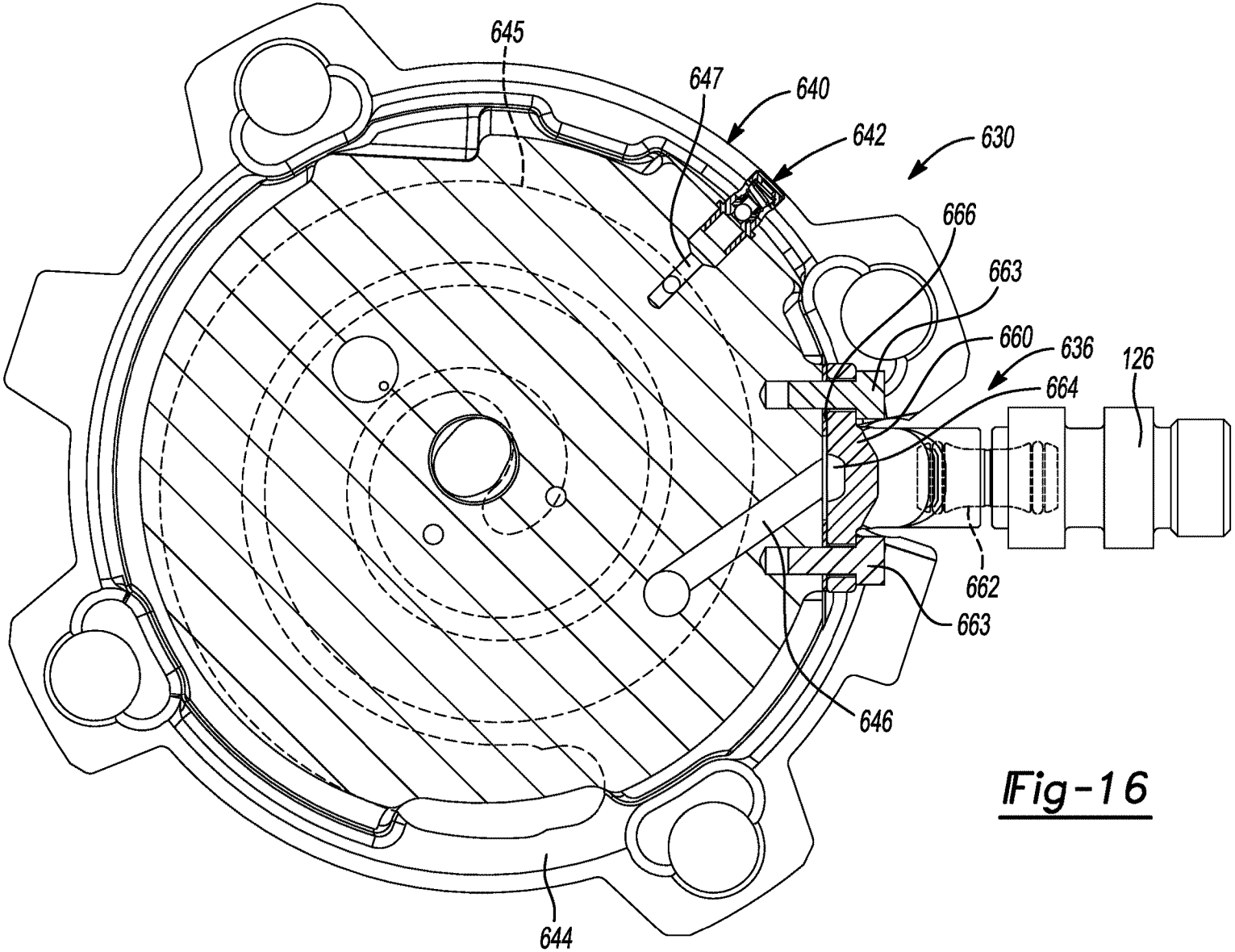
FIG. 16 is a cross-sectional view of the non-orbiting scroll and fluid-injection fitting assembly of FIG. 15.

With reference to FIGS. 15-16, another compression mechanism 630 and fluid-injection fitting assembly 636 is provided. The compression mechanism 630 may be incorporated into the compressor 12 instead of the compression mechanisms 30, 430 described above. The structure and function of the compression mechanism 630 may be similar or identical to that of the compression mechanisms 30, 430 described above, apart from any exception noted below.

The compression mechanism 630 may generally include an orbiting scroll or first scroll member (not shown), a non-orbiting scroll or second scroll member 640 and a valve assembly 642. The structure and function of the orbiting scroll may be similar or identical to that of the orbiting scroll 62 described above, and therefore, will not be described again in detail.

The non-orbiting scroll 640 may include an endplate 644 having a spiral wrap 645 projecting downwardly from the endplate 644. The spiral wrap 645 may form a meshing engagement with the wrap (not shown) of the orbiting scroll, thereby creating compression pockets (not shown). The endplate 644 may include an injection passage 646 and a venting passage 647 formed therein. The injection passage 646 may be in fluid communication with the fluid-injection fitting assembly 636 and one or more of the compression pockets. The injection passage 646 may allow working fluid from the fluid-injection fitting assembly 636 to flow into the one or more of the compression pockets. The venting passage 647 may be in fluid communication with the compression pockets and with the suction chamber 48 (via the valve assembly 642).

The function and structure of the valve assembly 642 may be similar or identical to that of the valve assembly 442, described above, and therefore, will not be described again in detail. The valve assembly 642 may be coupled to the endplate 644 and may allow fluid communication between the compression pockets and the suction chamber 48.

The fluid-injection fitting assembly 636 may include a scroll fitting 660 and a transfer conduit 662. The scroll fitting 660 may be at least partially disposed in the shell 38 and may be attached to the non-orbiting scroll 640 via bolts 663. The scroll fitting 660 may include a passage 664 that is in fluid communication with the injection passage 646 at a first end and in fluid communication with the transfer conduit 662 at a second end. A sealing member 666 (e.g., a gasket) is disposed between the non-orbiting scroll 640 and the scroll fitting 660 to prevent leakage from or into the injection passage 646 and/or the scroll fitting 660.

The structure and function of the transfer conduit 662 may be similar or identical to the transfer conduit 116, 462 described above, and therefore, will not be described again in detail.

If fluid pressures in the compression pockets due to the compressor 12 experiencing a flooded start condition exceeds a predetermined threshold value, the high pressure working fluid may flow through the venting passage 647 and into the suction chamber 48 (via the valve assembly 642). It should be understood that during normal operation of the system, fluid pressures are below the predetermined threshold value, and thus, the valve assembly 642 is in the closed position.

Figure 17:
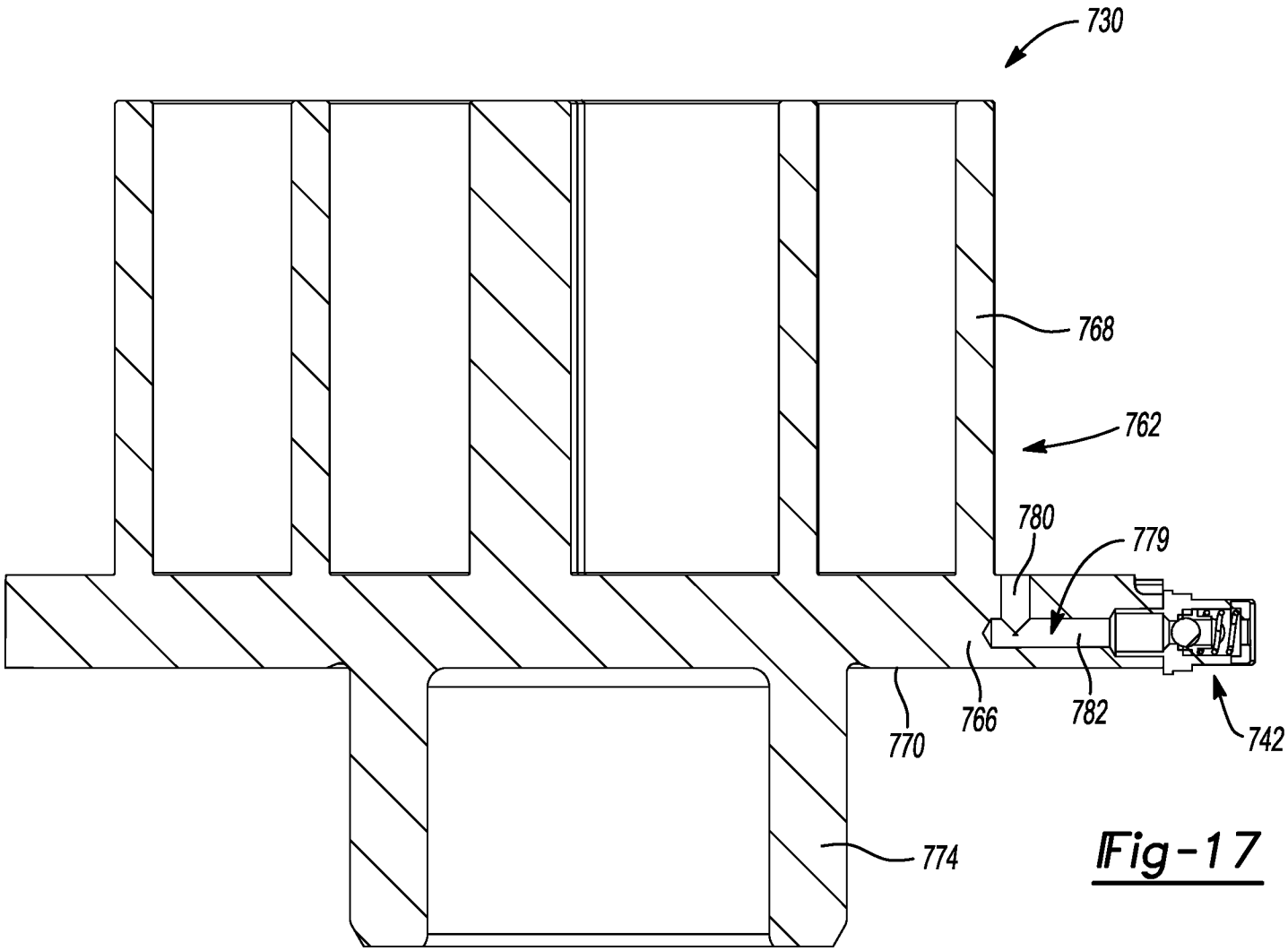
FIG. 17 is a cross-sectional view of an alternate orbiting scroll according to the principles of the present disclosure.

With reference to FIG. 17, another compression mechanism 730 is provided. The compression mechanism 730 may be incorporated into the compressor 12 instead of the compression mechanism 30, 430, 630 described above. The structure and function of the compression mechanism 730 may be similar or identical to that of the compression mechanism 30, 430, 630 described above, apart from any exception noted below.

The compression mechanism 730 may generally include a non-orbiting scroll (not shown), an orbiting scroll 762 and a valve assembly 742. The structure and function of the non-orbiting scroll may be similar or identical to that of the non-orbiting scroll 64 described above, and therefore, will not be described again in detail.

The orbiting scroll 762 may include an endplate 766 having a spiral vane or wrap 768 on the upper surface thereof and an annular flat thrust surface 770 on the lower surface. The wrap 768 may form a meshing engagement with the wrap (not shown) of the non-orbiting scroll, thereby creating compression pockets. The endplate 766 may include a venting passage 779 that may be in fluid communication with the compression pockets and with the suction chamber 48 (via the valve assembly 742). The venting passage 779 may have an axial extending portion 780 and a radial extending portion 782. The thrust surface 770 may interface with the annular flat thrust bearing surface 72 on the main bearing housing 28. A cylindrical hub 774 may project downwardly from the thrust surface 770 and may have a drive bushing (not shown) rotatably disposed therein.

The function and structure of the valve assembly 742 may be similar or identical to that of the valve assembly 442, 642 described above, and therefore, will not be described again in detail. The valve assembly 742 may be coupled to the endplate 766 and may allow fluid communication between the compression pockets and the suction chamber 48.

If fluid pressures in the compression pockets due to the compressor 12 experiencing a flooded start condition exceed a predetermined threshold value, the high pressure working fluid may flow through the venting passage 779 and into the suction chamber 48 (via the valve assembly 742). It should be understood that during normal operation of the system, fluid pressures are below the predetermined threshold value, and thus, the valve assembly 742 is in the closed position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a suction chamber;

a first scroll member disposed within the shell and including a first end plate having a first spiral wrap extending therefrom;

a second scroll member disposed within the shell and including a second end plate having a second spiral wrap extending therefrom and an injection passage formed in the second end plate, the second spiral wrap meshingly engaged with the first spiral wrap to form compression pockets, the injection passage being in fluid communication with a radially intermediate one of the compression pockets;

a fluid-injection fitting assembly at least partially disposed within the shell and in fluid communication with the injection passage, the fluid-injection fitting assembly configured to provide working fluid to the radially intermediate one of the compression pockets via the injection passage; and a valve assembly movable between a closed position in which fluid communication between the radially intermediate one of the compression pockets and the suction chamber is prevented and an open position in which fluid communication between the radially intermediate one of the compression pockets and the suction chamber is allowed, wherein the valve assembly moves from the closed position to the open position when a fluid pressure within the radially intermediate one of the compression pockets exceeds a predetermined threshold value.

2. The compressor of claim 1, wherein the valve assembly includes a valve housing, a valve body, and a spring that biases the valve body toward the closed position, and wherein the valve body is movable relative to the valve housing from the closed position to the open position when fluid pressure in the radially intermediate one of the compression pockets exceeds the predetermined threshold value.

3. The compressor of claim 2, wherein the fluid-injection fitting assembly includes a scroll fitting and a transfer conduit attached to the scroll fitting, and wherein the valve assembly is coupled to the scroll fitting of the fluid-injection fitting assembly.

4. The compressor of claim 3, wherein high-pressure working fluid in the radially intermediate one of the compression pockets flows to a passage formed in the scroll fitting and out an aperture formed in the valve housing into the suction chamber when the valve body is movable from the closed position to the open position.

5. The compressor of claim 2, wherein working fluid in the radially intermediate one of the compression pockets flows to the injection passage and out an aperture formed in an end cap of the valve assembly into the suction chamber when the valve body is movable from the closed position to the open position.

6. The compressor of claim 2, wherein the valve assembly is coupled to the second end plate of the second scroll member.

7. The compressor of claim 6, wherein a passage is formed in the second end plate of the second scroll member and is in fluid communication with the radially intermediate one of the compression pockets.

8. The compressor of claim 7, wherein working fluid in the compression pockets flows to the passage and out an aperture formed in an end cap of the valve assembly into the suction chamber when the valve body is movable from the closed position to the open position.

9. The compressor of claim 1, wherein the predetermined threshold value is greater than or equal to 500 psi.

10. The compressor of claim 1, wherein the injection passage and the fluid-injection fitting assembly cooperate to define a fluid circuit, and wherein fluid communication between the radially intermediate one of the compression pockets and the suction chamber via the fluid circuit is allowed when the valve assembly is in the open position.

11. A compressor comprising:

a shell defining a suction chamber;

a first scroll member disposed within the shell and including a first end plate having a first spiral wrap extending therefrom;

a second scroll member disposed within the shell and including a second end plate having a second spiral wrap extending therefrom and an injection passage formed in the second end plate, the second spiral wrap meshingly engaged with the first spiral wrap to form compression pockets, the injection passage being in fluid communication with a radially intermediate one of the compression pockets;

a fluid-injection fitting assembly at least partially disposed within the shell and in fluid communication with the injection passage, the fluid-injection fitting assembly configured to provide working fluid to the radially intermediate one of the compression pockets via the injection passage; and a valve assembly coupled to the fluid-injection fitting assembly and movable between a closed position in which fluid communication between the radially intermediate one of the compression pockets and the suction chamber is prevented and an open position in which fluid communication between the radially intermediate one of the compression pockets and the suction chamber is allowed, wherein the valve assembly moves from the closed position to the open position when a pressure difference of working fluid within the radially intermediate one of the compression pockets and working fluid in the suction chamber exceeds a predetermined threshold value.

12. The compressor of claim 11, wherein the fluid-injection fitting assembly includes a scroll fitting and a transfer conduit attached to the scroll fitting, and wherein the valve assembly is coupled to the scroll fitting of the fluid-injection fitting assembly, and wherein the valve assembly includes a valve flap that is movable relative to the scroll fitting from the closed position to the open position when the pressure difference of working fluid in the radially intermediate one of the compression pockets and working fluid in the suction chamber exceeds the predetermined threshold value.

13. The compressor of claim 12, wherein working fluid in the radially intermediate one of the compression pockets flows to a first passage formed in the scroll fitting and out a second passage formed in the scroll fitting into the suction chamber when the valve flap is movable from the closed position to the open position.

14. The compressor of claim 11, wherein the fluid-injection fitting assembly includes a scroll fitting and a transfer conduit attached to the scroll fitting, and wherein the valve assembly is coupled to the transfer conduit, and wherein the valve assembly includes a valve flap that is movable relative to the transfer conduit from the closed position to the open position when the pressure difference of working fluid in the radially intermediate one of the compression pockets and working fluid in the suction chamber exceeds the predetermined threshold value.

15. The compressor of claim 14, wherein working fluid in the radially intermediate one of the compression pockets flows through a first passage formed in the scroll fitting and out an aperture formed in the transfer conduit into the suction chamber when the valve flap is movable from the closed position to the open position.

16. The compressor of claim 11, wherein the injection passage and the fluid-injection fitting assembly cooperate to define a fluid circuit, and wherein fluid communication between the radially intermediate one of the compression pockets and the suction chamber via the fluid circuit is allowed when the valve assembly is in the open position.

17. A climate-control system comprising:

a compressor defining a suction chamber and including a first inlet, a second inlet and a compression mechanism forming a plurality of compression pockets, the first inlet in fluid communication with the suction chamber, the second inlet in fluid communication with a radially intermediate one of the compression pockets;

a first fluid passageway including a first heat exchanger, the first fluid passageway providing working fluid from the first heat exchanger to the first inlet;

a second fluid passageway extending between a second heat exchanger and the second inlet, the second fluid passageway providing working fluid from the second heat exchanger to the second inlet;

a conduit extending from the first fluid passageway to the second fluid passageway; and a valve disposed along the conduit and movable between a closed position in which fluid communication between the radially intermediate one of the compression pockets and the suction chamber via the conduit is prevented and an open position in which fluid communication between the radially intermediate one of the compression pockets and the suction chamber via the conduit is allowed, wherein the valve moves from the closed position to the open position when a fluid pressure in the radially intermediate one of the compression pockets exceeds a predetermined threshold value.

18. The climate-control system of claim 17, wherein the predetermined threshold value is greater than or equal to 500 psi.

19. The climate-control system of claim 17, wherein the conduit extends from the first fluid passageway at a location between the first inlet and the first heat exchanger to the second fluid passageway at a location between the second heat exchanger and the second inlet.

20. The climate-control system of claim 17, wherein the first heat exchanger is an evaporator, and the second heat exchanger is a condenser.

21. The climate-control system of claim 17, wherein working fluid in the compression pocket flows through the conduit, the first inlet and into the suction chamber when the valve is movable from the closed position to the open position.

* * * * *